US009837176B2

(12) United States Patent
Diamond et al.

(10) Patent No.: US 9,837,176 B2
(45) Date of Patent: Dec. 5, 2017

(54) PRODUCTION OF MOLYBDENUM-99 USING ELECTRON BEAMS

(71) Applicant: Canadian Light Source Inc., Saskatoon (CA)

(72) Inventors: William Diamond, Deep River (CA); Vinay Nagarkal, Saskatoon (CA); Mark de Jong, Saskatoon (CA); Christopher Regier, Saskatoon (CA); Linda Lin, Saskatoon (CA); Douglas Ullrich, Saskatoon (CA)

(73) Assignee: Canadian Light Source Inc., Saskatoon (CA)

( * ) Notice: Subject to any disclaimer, the term of this patent is extended or adjusted under 35 U.S.C. 154(b) by 1054 days.

(21) Appl. No.: 14/286,547

(22) Filed: May 23, 2014

(65) Prior Publication Data

US 2014/0348284 A1 Nov. 27, 2014

Related U.S. Application Data

(63) Continuation-in-part of application No. 13/901,213, filed on May 23, 2013.

(51) Int. Cl.

| | |
|---|---|
| ***G21G 1/06*** | (2006.01) |
| ***G21G 4/08*** | (2006.01) |
| *G21G 1/00* | (2006.01) |

(52) U.S. Cl.

CPC ..... *G21G 1/06* (2013.01); *G21G 1/001* (2013.01); *G21G 4/08* (2013.01); *G21G 2001/0036* (2013.01)

(58) Field of Classification Search

CPC ..... G21G 1/06; G21G 1/001; G21G 4/08; G21G 2001/0036

See application file for complete search history.

(56) References Cited

U.S. PATENT DOCUMENTS

| | | | |
|---|---|---|---|
| 5,784,423 | A | 7/1998 | Lidsky et al. |
| 2010/0028234 | A1 | 2/2010 | Ehst et al. |
| 2012/0281799 | A1 | 11/2012 | Wells et al. |

FOREIGN PATENT DOCUMENTS

| | | | |
|---|---|---|---|
| CN | 1166228 | A | 11/1997 |
| JP | 2011153827 | A | 8/2011 |

(Continued)

OTHER PUBLICATIONS

International Preliminary Report on Patentability (Chapter 2 of the PCT), received in related International Patent Application No. PCT/CA2014/050479, dated Aug. 4, 2015.

(Continued)

*Primary Examiner* — Jack W Keith
*Assistant Examiner* — Lily C Garner
(74) *Attorney, Agent, or Firm* — McCarthy Tétrault LLP

(57) ABSTRACT

An apparatus for producing $^{99}$Mo from a plurality of $^{100}$Mo targets through a photo-nuclear reaction on the $^{100}$Mo targets. The apparatus comprises: (i) an electron linear accelerator component; (ii) an energy converter component capable of receiving the electron beam and producing therefrom a shower of bremsstrahlung photons; (iii) a target irradiation component for receiving the shower of bremsstrahlung photons for irradiation of a target holder mounted and positioned therein. The target holder houses a plurality of $^{100}$Mo target discs. The apparatus additionally comprises (iv) a target holder transfer and recovery component for receiving, manipulating and conveying the target holder by remote control; (v) a first cooling system sealingly engaged with the energy converter component for circulation of a coolant fluid therethrough; and (vi) a second cooling system sealingly engaged with the target irradiation component for circulation of a coolant fluid therethrough.

20 Claims, 26 Drawing Sheets

(56) References Cited

FOREIGN PATENT DOCUMENTS

| | | | |
|---|---|---|---|
| WO | 97/09724 | A1 | 3/1997 |
| WO | 2014186898 | A1 | 11/2014 |

OTHER PUBLICATIONS

Office Action dated Dec. 21, 2016, and English translation thereof, received in related Chinese Application No. 201480041163.2.
Extended European Search report dated Jan. 3, 2017, received in related European Application No. 14801507.6.
Notification Concerning Transmittal of International Preliminary Report on Patentability (Chapter 1 of the PCT) received in related International Patent Application No. PCT/CA2015/050473, dated Dec. 8, 2016.

PRODUCTION OF MOLYBDENUM-99 USING ELECTRON BEAMS

CROSS-REFERENCE TO RELATED APPLICATIONS

This application is a continuation-in-part of U.S. application Ser. No. 13/901,213, filed on May 23, 2013. The contents of the referenced application are incorporated by reference.

TECHNICAL FIELD

The present disclosure pertains to processes, systems, and apparatus, for production of molybdenum-99. More particularly, the present disclosure pertains to production of molybdenum-99 from molybdenum-100 targets using high-power electron linear accelerators.

BACKGROUND

Technetium-99m, referred to hereinafter as $^{99m}$Tc, is one of the most widely used radioactive tracers in nuclear medicine diagnostic procedures. $^{99m}$Tc is used routinely for detection of various forms of cancer, for cardiac stress tests, for assessing the densities of bones, for imaging selected organs, and other diagnostic testing. $^{99m}$Tc emits readily detectable 140 keV gamma rays and has a half-life of only about six hours, thereby limiting patients' exposure to radioactivity. Because of its very short half-life, medical centres equipped with nuclear medical facilities derive $^{99m}$Tc from the decay of its parent isotope molybdenum-99, referred to hereinafter as $^{99}$Mo, using $^{99m}$Tc generators. $^{99}$Mo has a relatively long half life of 66 hours which enables its world-wide transport to medical centres from nuclear reactor facilities wherein large-scale production of $^{99}$Mo is derived from the fission of highly enriched $^{235}$Uranium. The problem with nuclear production of $^{99}$Mo is that its world-wide supply originates from five nuclear reactors that were built in the 1960s, and which are close to the end of their lifetimes. Almost two-thirds of the world's supply of $^{99}$Mo currently comes from two reactors: (i) the National Research Universal Reactor at the Chalk River Laboratories in Ontario, Canada, and (ii) the Petten nuclear reactor in the Netherlands. In the past few years, there have been major shortages of $^{99}$Mo as a consequence of planned unplanned shutdowns at both of the major of production reactors. Consequently, serious shortages occurred at the medical facilities within several weeks of the reactor shutdowns, causing significant reductions in the provision of medical diagnostic testing and also, placing great production demands on the remaining nuclear reactors. Although both facilities are now active again, there is much global uncertainty regarding a reliable long-term supply of $^{99}$Mo.

SUMMARY

The exemplary embodiments of the present disclosure pertain to apparatus, systems, and processes for the production of molybdenum-99 ($^{99}$Mo) from molybdenum-100 ($^{100}$Mo) by high-energy electron irradiation with linear accelerators. Some exemplary embodiments relate to systems for working the processes of present disclosure. Some exemplary embodiments relate to apparatus comprising the systems of the present disclosure.

DESCRIPTION OF THE DRAWINGS

The present disclosure will be described in conjunction with reference to the following drawings in which.

DETAILED DESCRIPTION

Figure 1:
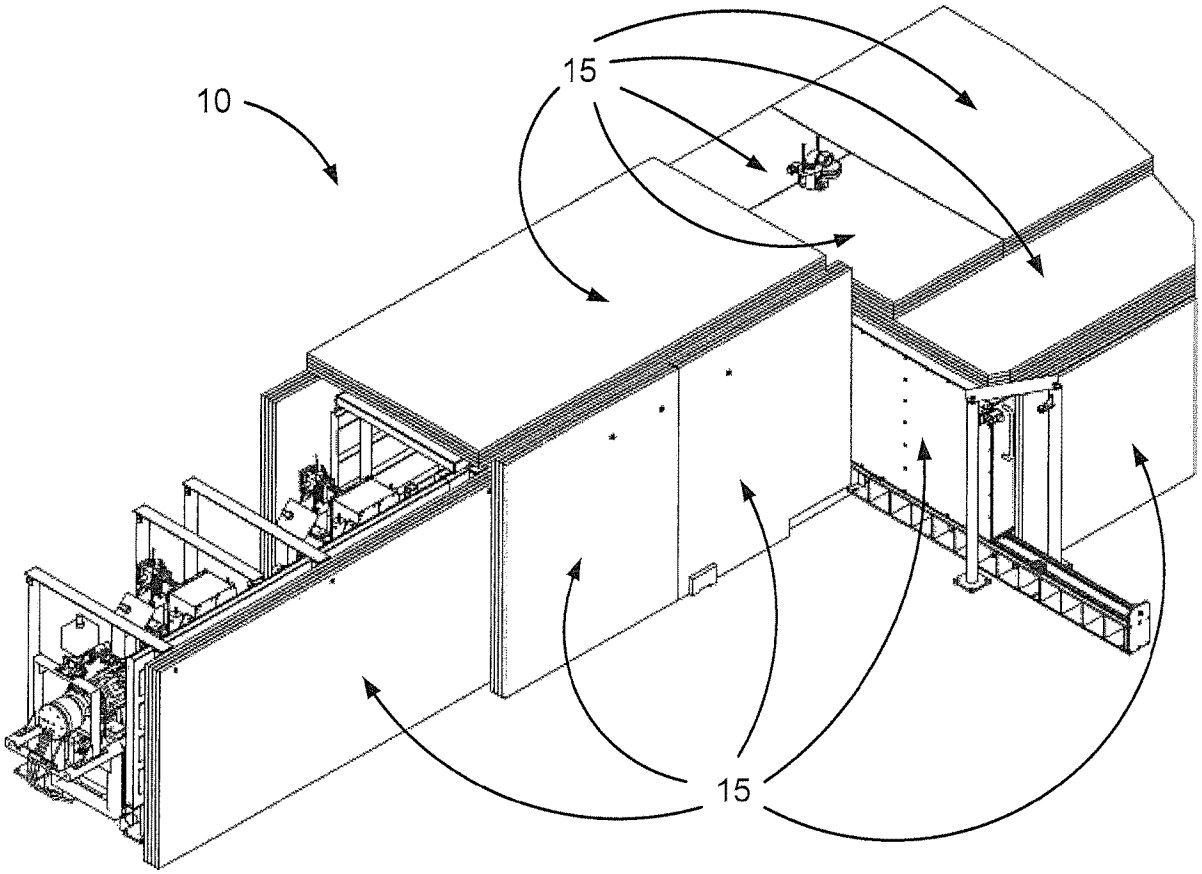
FIG. 1 is a perspective illustration of an exemplary system of the present disclosure, shown with protective shielding in place.
Figure 2:
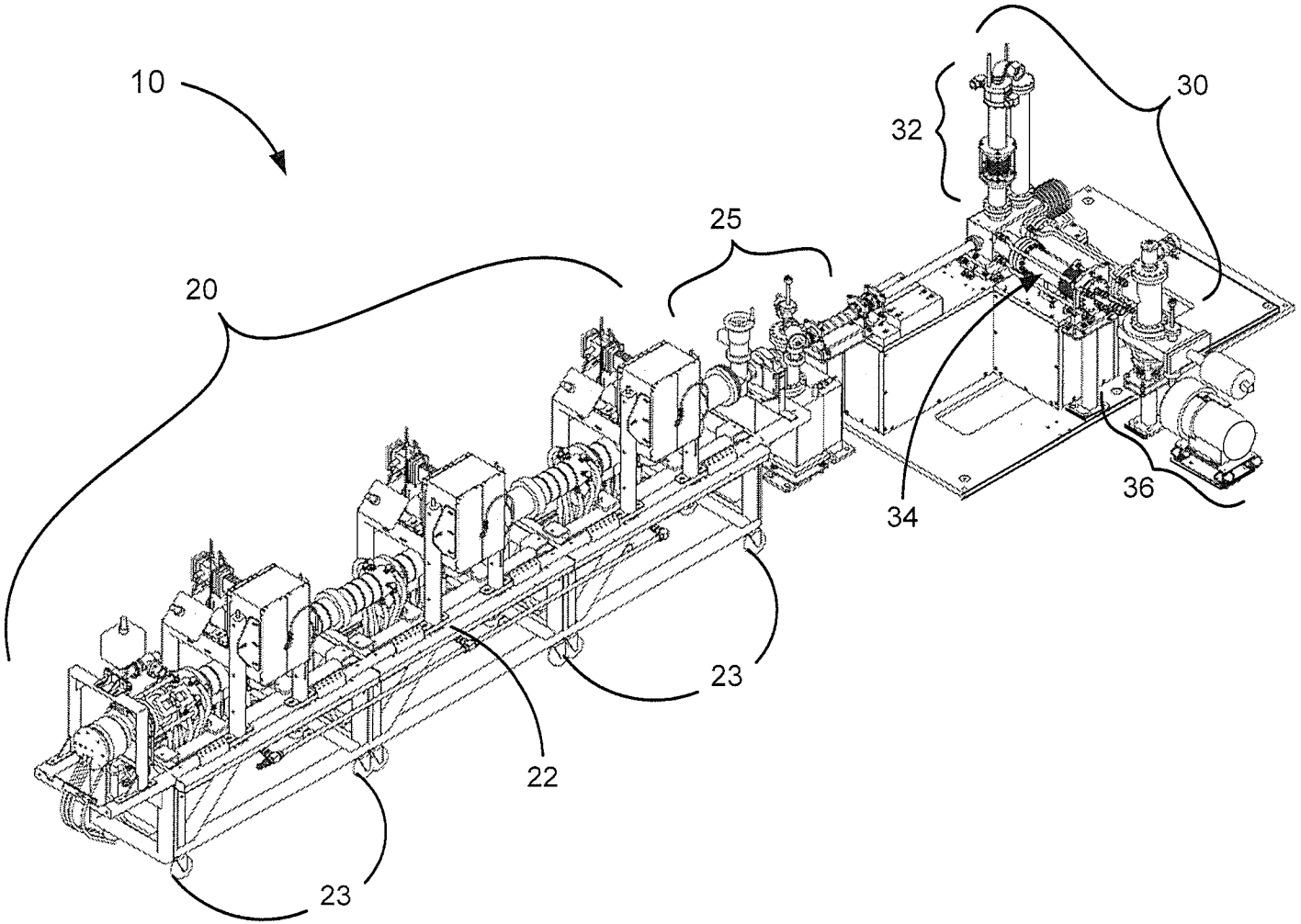
FIG. 2 is a perspective view of the exemplary system from FIG. 1, shown with the protective shielding removed.
Figure 3:
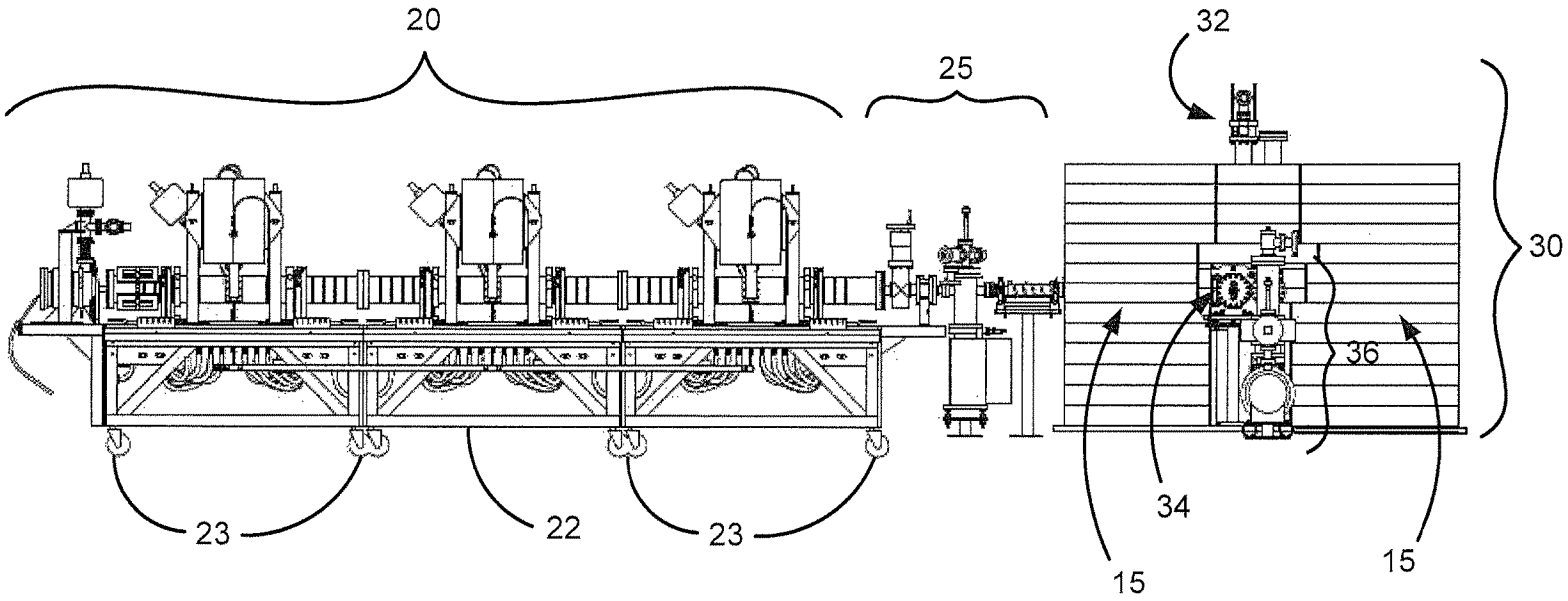
FIG. 3 is a side view of the exemplary system from FIG. 2, shown with protective shielding removed from the linear accelerator components of the system.
Figure 4:
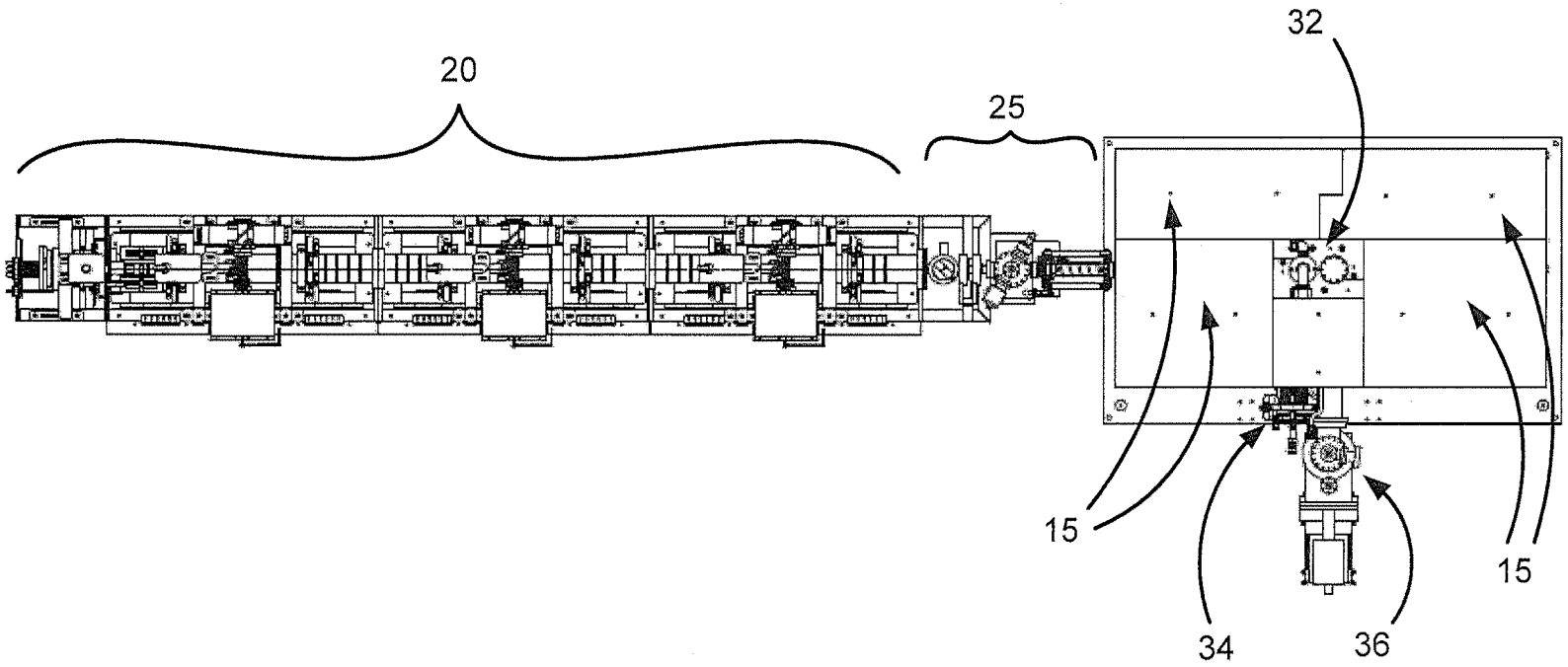
FIG. 4 is a top view of the exemplary system shown in FIG. 3.
Figure 5:
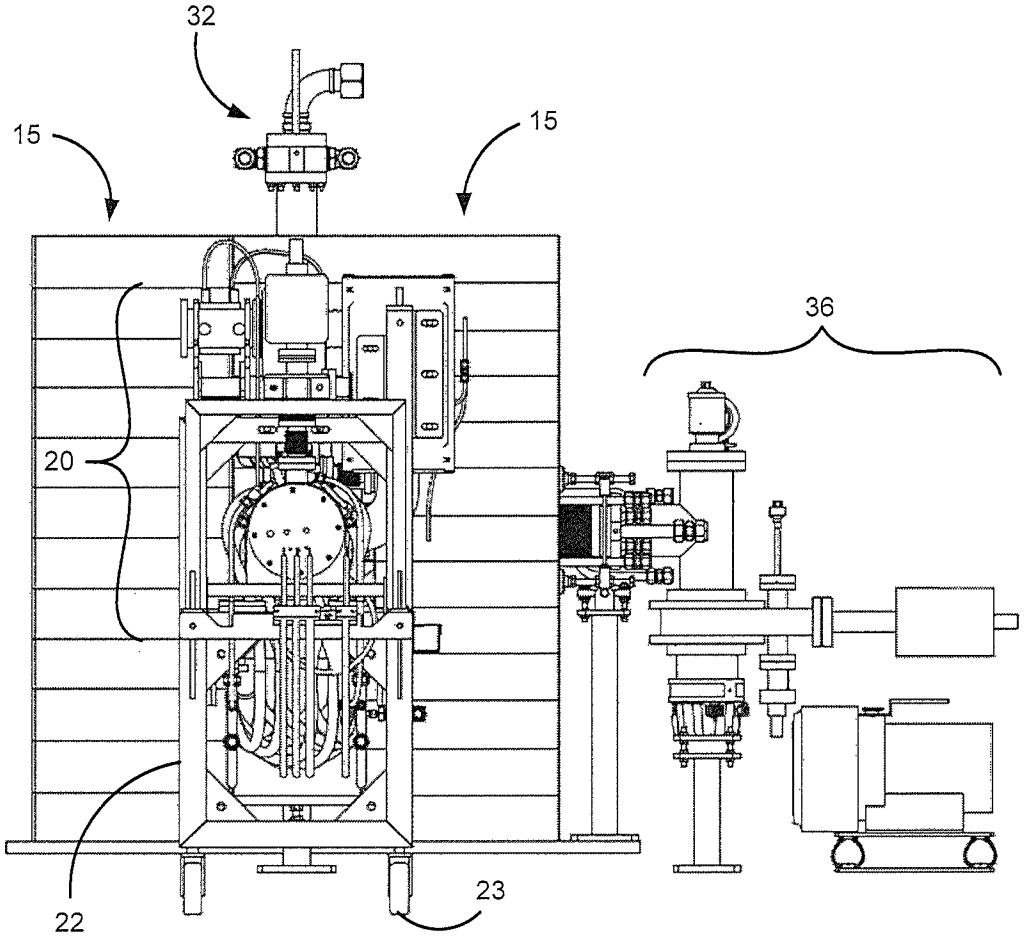
FIG. 5 is an end view of the from FIG. 3, shown from the end with the linear accelerator components.
Figure 6:
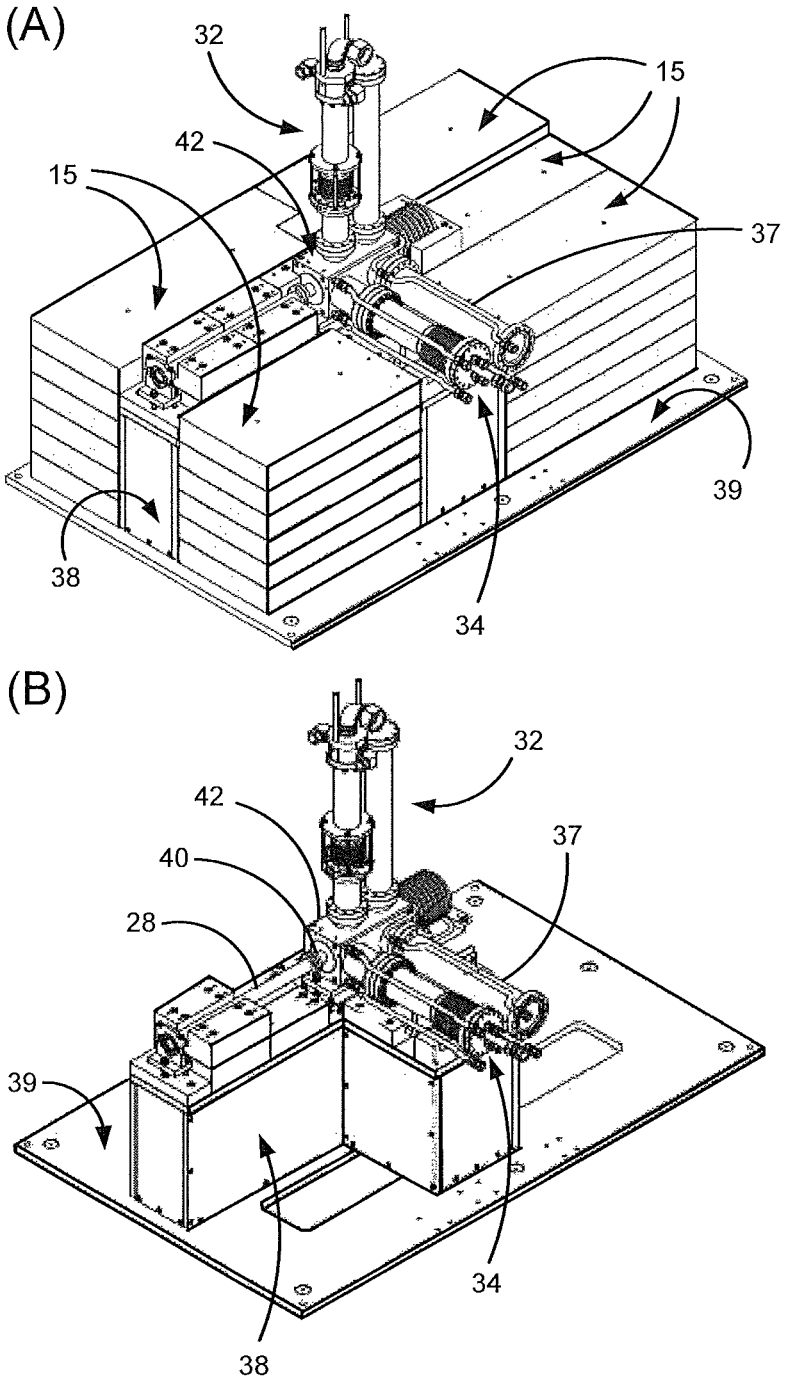
FIG. 6(A) is a perspective view showing the target assembly component of the exemplary system from FIG. 2 partially unclad with the protective shielding component, while 6(B) is a perspective view showing the target assembly component unclad.

The exemplary embodiments of the present disclosure pertain to systems, apparatus, and processes for producing $^{99}$Mo from $^{100}$Mo targets using high-energy radiation from electron beams generated by linear particle accelerators.

A linear particle accelerator (often referred to as a "linac") is a particle accelerator that greatly increases the velocity of charged subatomic particles by subjecting the charged particles to a series of oscillating electric potentials along a linear beamline. Generation of electron beams with a linac generally requires the following elements: (i) a source for generating electrons, typically a cathode device, (ii) a high-voltage source for initial injection of the electrons into (iii) a hollow pipe vacuum chamber whose length will be dependent on the energy desired for the electron beam, (iv) a plurality of electrically isolated cylindrical electrodes placed along the length of the pipe, (v) a source of radio frequency energy for energizing each of cylindrical electrodes, i.e., one energy source per electrode, (vi) a plurality of quadrupole magnets surrounding the pipe vacuum chamber to focus the electron beam, (vii) an appropriate target, and (viii) a cooling system for cooling the target during radiation with the electron beam. Linacs have been used routinely for various uses such as the generation of X-rays, and for generation of high energy electron beams for providing radiation therapies to cancer patients.

Linacs are also commonly used as injectors for higher-energy accelerators such as synchrotrons, and may also be used directly to achieve the highest kinetic energy possible for light particles for use in particle physics through bremsstrahlung radiation. Bremsstrahlung radiation is the electromagnetic radiation produced by the deceleration of a charged particle when deflected by another charged particle, typically of an electron by an atomic nucleus. The moving electron loses kinetic energy, which is converted into a photon because energy is conserved. Bremsstrahlung radiation has a continuous spectrum which becomes more intense and whose peak intensity shifts toward higher frequencies as the change of the energy of the accelerated electrons increases.

However, to those skilled in these arts, it would seem that using electron linacs to produce high-energy photons through bremsstrahlung radiation to then produce radioisotopes through a photo-nuclear reaction would be an inefficient process for production of radio isotopes because the electromagnetic interactions of electrons with nuclei are usually significantly smaller than the strong interactions with protons as the incident particles. We have determined however, that $^{100}$Mo has a broad "giant dipole resonance" (GDR) for photo-neutron reactions around 15 MeV photon energy which results in a significant enhancement of the reaction cross-section between $^{100}$Mo and $^{99}$Mo. Also, the radiation length of a high-energy photon in the 10 to 30 MeV range in $^{100}$Mo is about 10 mm which is significantly longer than the range of a proton of the same energy. Consequently, the effective target thickness is also much larger for photo-neutron reactions compared to proton reactions. The reduced number of reaction channels associated with linac-generated electron beams limits the production of undesirable isotopes, in comparison, using proton beams to directly produce $^{99}$Tc from $^{100}$Mo often results in the generation of other Tc isotopes from other stable Mo isotopes that may be present in the enriched $^{100}$Mo targets. Medical applications place strict limits on the amounts of other radio-isotopes that may be present with $^{99}$Tc, and it would seem that production of $^{99}$Tc from $^{100}$Mo with linac-generated electron would be preferable because the risk of producing other Tc isotopes is significantly lower. Furthermore, it appears that photo-neutron reactions with other Mo isotopes present in $^{100}$Mo targets usually results in stable Mo.

Accordingly, one embodiment of the present disclosure pertains to an exemplary high-power linac electron beam apparatus for producing $^{99}$Mo from a plurality of $^{100}$Mo targets through a photo-nuclear reaction on the $^{100}$Mo targets. The apparatus generally comprises at least (i) an electron linear accelerator capable of producing electrons beams having at least 5 kW of power, about 10 kW of power, about 15 kW of power, about 20 kW of power, about 25 kW of power, about 30 kW of power, about 35 kW of power, about 45 kW of power, about 60 kW of power, about 75 kW of power, about 100 kW of power, (ii) a water-cooled converter to produce a high flux of high-energy bremsstrahlung photons of at least 20 MeV from the electron beam generated by the linear accelerator, a flux of about 25 MeV of bremsstrahlung photons, a flux of about 30 MeV of bremsstrahlung photons, a flux of about 35 MeV of bremsstrahlung photons, a flux of about 40 MeV of bremsstrahlung photons, a flux of about 45 MeV of bremsstrahlung photons, (iii) of a water-cooled target assembly component for mounting therein a target holder housing a plurality of $^{100}$Mo targets and for precisely positioning and aligning the target holder for interception of beam of high-energy bremsstrahlung photon radiation produced by the water-cooled converter, and (iv) a plurality of shielding components for cladding the water-cooled target assembly component to contain gamma radiation and/or neutron radiation within the target assembly component and to prevent radiation leakage outside of the apparatus. Depending on the component being shielded and its location within the installation, the shielding may comprise one or more of lead, steel, copper, and polyethylene. The apparatus additionally comprises (v) an integrated target transfer assembly with a component for remote-controlled loading and conveying a plurality of target holders, each of the target holders loaded with a plurality of $^{100}$Mo targets, to a target drive component. An individual loaded target holder is transferrable from the loading/conveying component by remote control into a target drive component contained within the water-cooled target assembly component. The target holder is conveyed with the target drive component to a position which intercepts the bremsstrahlung photon radiation. The base of the target drive component is engaged with a target aligning centering component which precisely positions and aligns the loaded target holder for maximum interception of the bremsstrahlung photon radiation. The integrated target transfer assembly is additionally configured for remote controlled removal of an irradiated target holder from the target drive component and transfer to a lead-shielded hot cell for separation and recovery of $^{99}$Tc decaying from $^{99}$Mo associated with the irradiated $^{100}$Mo targets. Alternatively, the irradiated $^{100}$Mo targets may be transferred into a lead-shielded shipping container for transfer to a hot cell off site.

It is apparent that the maximum achievable $^{99}$Mo yield is dependent on the amount of energy which can be safely deposited in the $^{100}$Mo targets, and also on the probability of giant dipole resonance photons interacting with the target nuclei. The amount of energy which can be safely deposited in the $^{100}$Mo targets depends on the heat capacity of the target assembly. If it is possible to quickly transfer large amounts of heat from the $^{100}$Mo targets, then it should be possible to deposit more energy into the $^{100}$Mo targets before they melt. Water is a desired coolant as it facilitates large heat dissipation and is also economical. Unfortunately, as the electron beam passes through cooling water within the bremsstrahlung converter component, the energy associated with the electron beam causes the water to undergo radiolysis. The radiolysis of water produces, among other things, gaseous hydrogen which creates an explosion hazard and also hydrogen peroxide which is corrosive to molybdenum and therefore, can greatly decrease the potentially achievable yields of $^{99}$Mo from the $^{100}$Mo targets. The energy associated with the bremsstrahlung photons passing through the cooling water in the water-cooled target assembly component housing the $^{100}$Mo targets also causes production of hydrogen peroxide from the water but much lower amounts of gaseous hydrogen.

Accordingly, another embodiment of the present disclosure is that separate cooling water systems are required for the water-cooled energy converter and for the water-cooled target assembly component to enable separate heat load dissipation from the two components, to maximize $^{99}$Mo production from the $^{100}$Mo targets.

It is within the scope of the present disclosure to incorporate into a first cooling water system for the bremsstrahlung converter component an apparatus or equipment or a device for combining the gaseous hydrogen with oxygen to form water within the recirculating water. It is optional to use gaseous coolants for cooling the bremsstrahlung converter component or alternatively, to supplement the water cooling of the bremsstrahlung converter component.

It is within the scope of the present disclosure to incorporate into a second cooling water system for the water-cooled target assembly component, one or more of buffers for ameliorating the corrosive effects of hydrogen peroxide on molybdenum, sacrificial metals, and supplemental gaseous coolant circulation. Suitable buffers are exemplified by lithium hydroxide, ammonium hydroxide and the like. Suitable sacrificial metals are exemplified by copper, titanium, stainless steel, and the like.

An exemplary high-power lime electron beam apparatus 10 for producing $^{99}$Mo from plurality of $^{100}$Mo targets is shown in FIGS. 1-5 and comprises a 35 MeV, 40 kW electron linac 20 manufactured by Mevex Corp. (Ottawa, ON, CA), a collimator station 25 to narrow the beam of electrons generated by the linac 20, and a target assembly station 30 comprising a target radiation chamber 42 (FIGS. 6-11), a cooling tower assembly 32, a cooling liquid supply 34, and vacuum apparatus 36 connected to the target radiation chamber 42 by vacuum pipe 37. The components 20, 25, 30 comprising the linac electron beam apparatus 10 are shielded with protective shield cladding 15 to contain and confine gamma radiation and/or neutron radiation. The 35 MeV, 40 kW electron linac 20 comprises three 1.2 m S-band on-axis coupled standing-wave sections, three modulators plus high-duty factor klystrons having 5 MW peaks, and a 60-kV thermionic gun. The linac 20 is mounted on a support framework 22 provided with rollers 23 to enable disengagement of the linac 20 from the collimator station 25 for access to and maintenance of the converter station 25 components. The collimator station 25 comprises a water-cooled tapered copper tube communicating with the first cooling water system, wherein the tapered copper tube is provided with a beryllium window for narrowing the electron beam generated by the linac 20 to a diameter of about 0.075 cm to about 0.40 cm, about 0.10 cm to about 0.35 cm, about 0.15 cm to about 0.30 cm, about 0.20 to about 0.25 cm.

Figure 7:
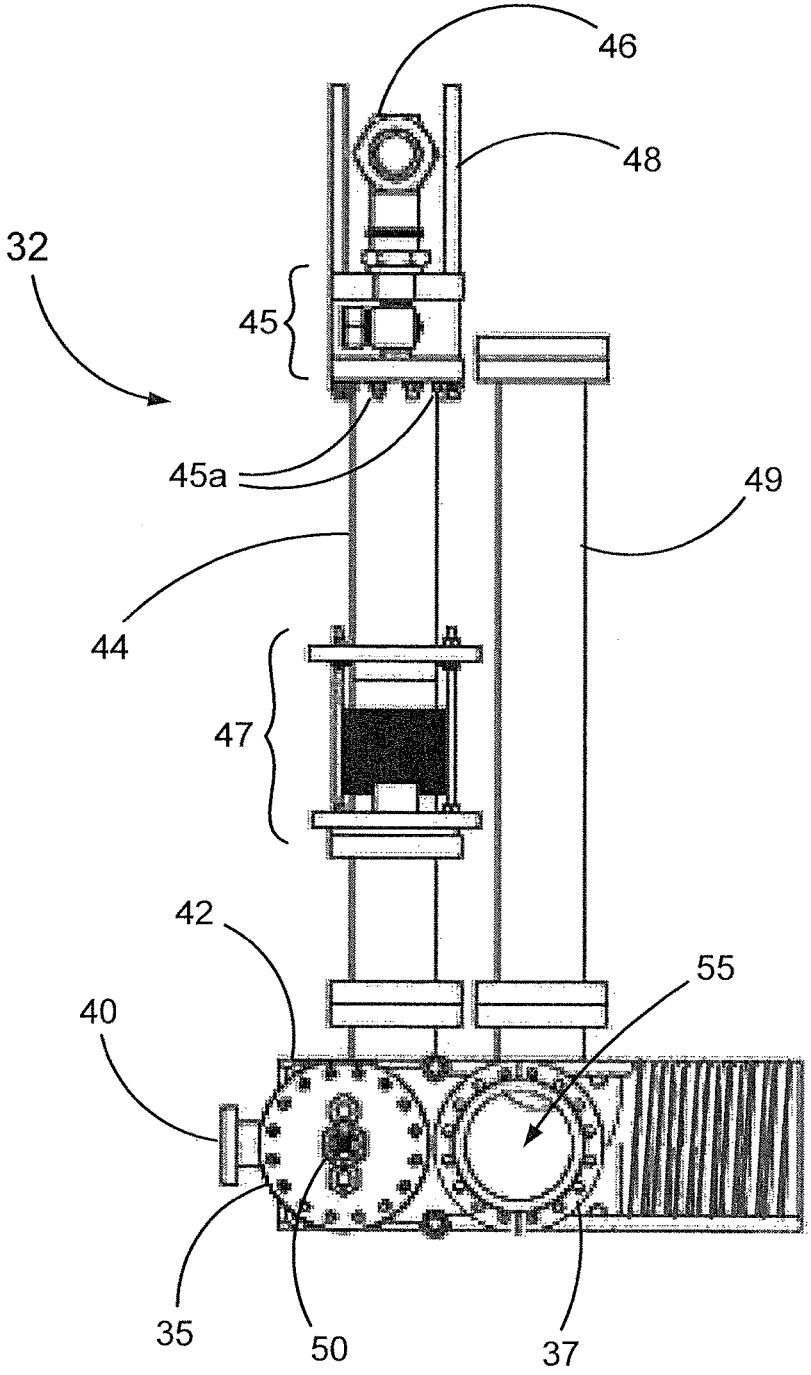
FIG. 7 is a side view of the target drive assembly (perpendicular to the electron beam generated by the linear accelerator)
Figure 8:
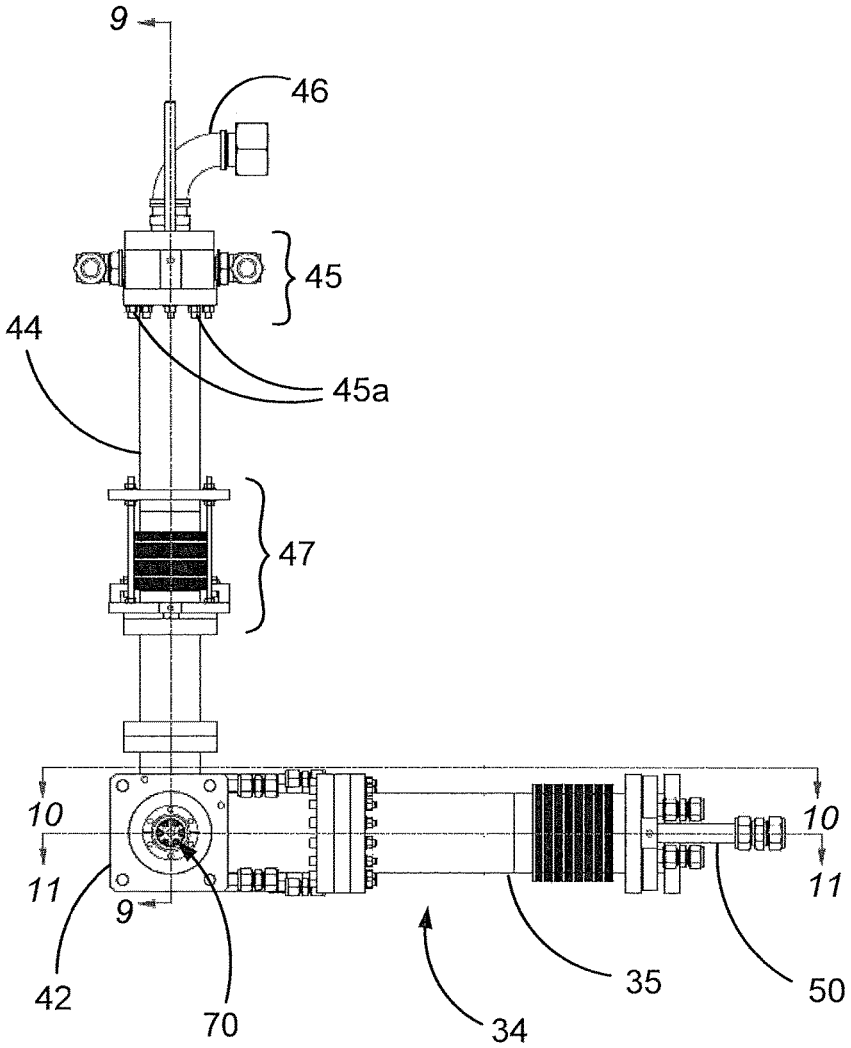
FIG. 8 is a front view of the target drive assembly showing the inlet for the bremsstrahlung photon beam generated from the linac electron beam.
Figure 9:
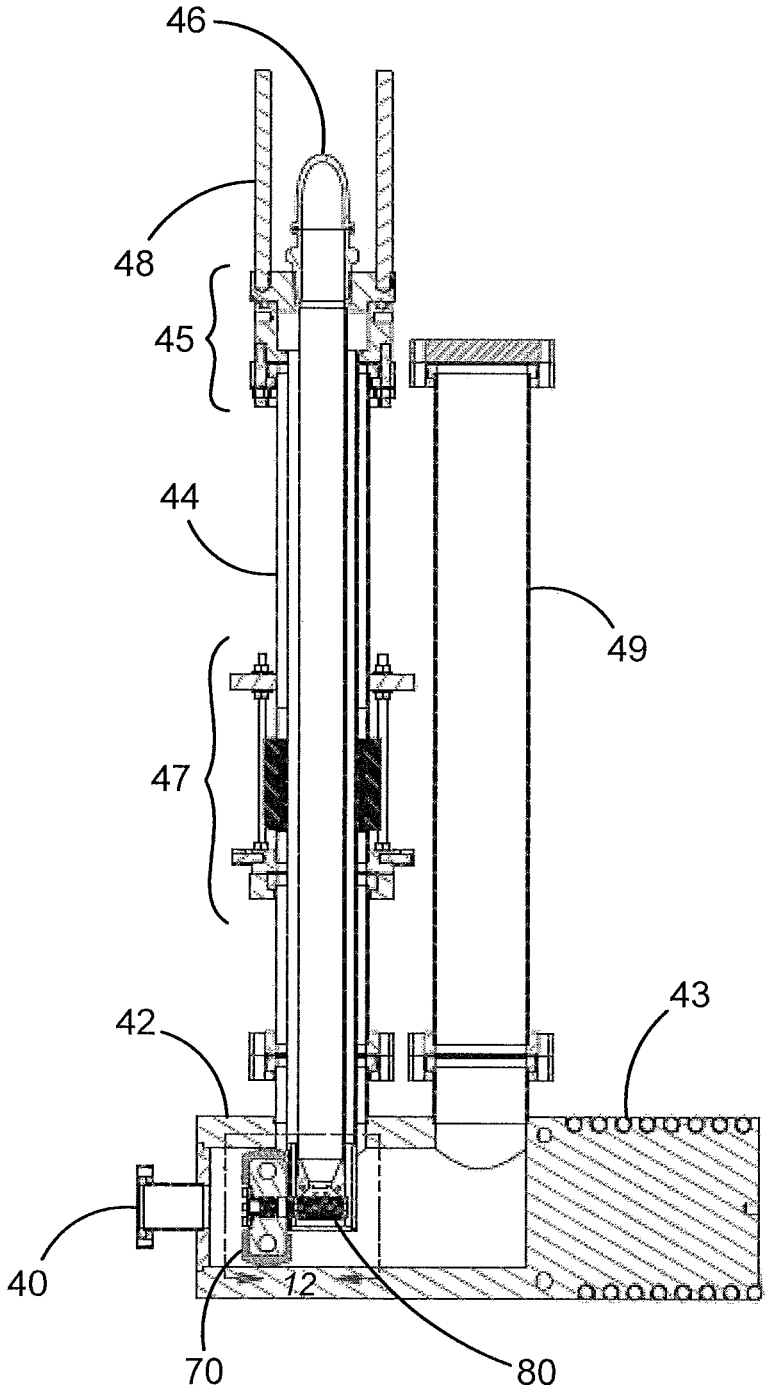
FIG. 9 is a cross-sectional side view of the target drive assembly shown in FIG. 8.
Figure 10:
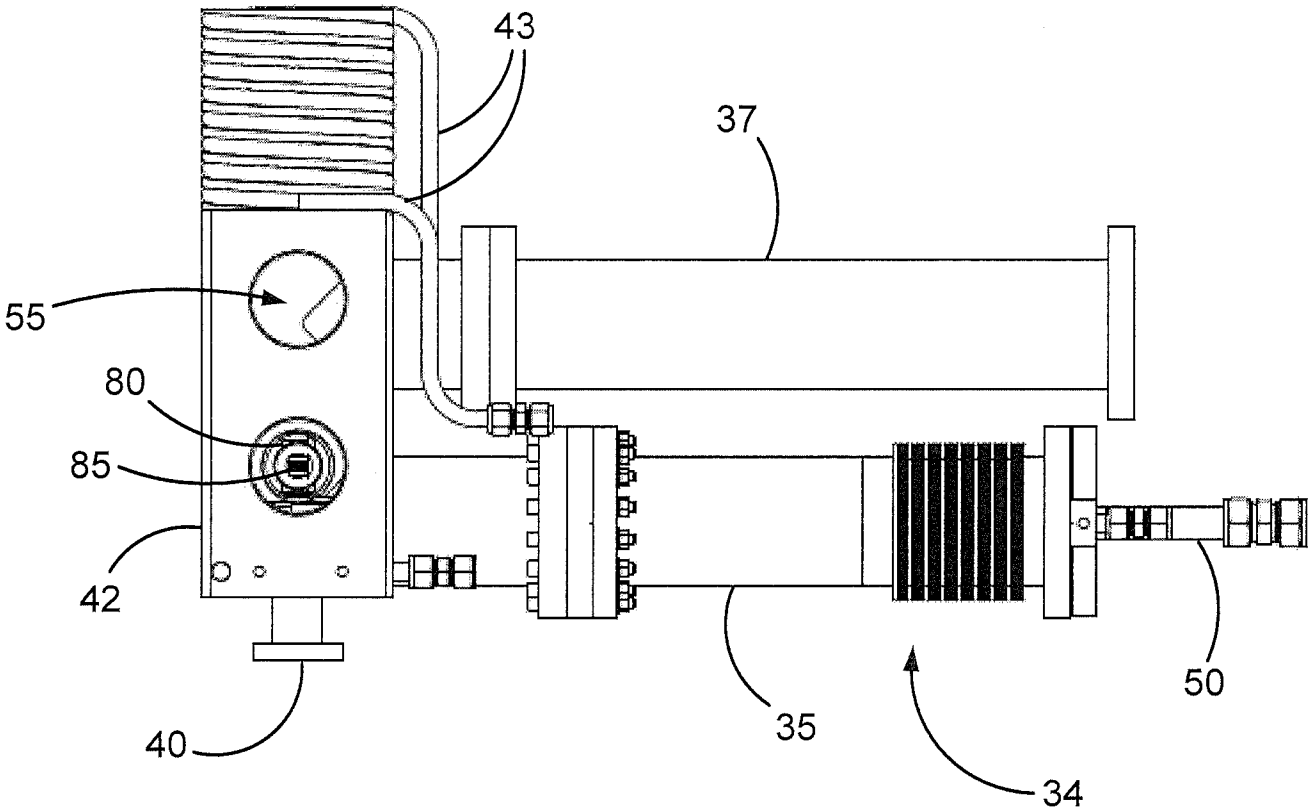
FIG. 10 is a cross-sectional top view of the target drive assembly shown in FIG. 8 at the junction of the cooling tower component and the housing for the beamline.

The target assembly station 30 comprises a support plate 39 for a support member 38 onto which is mounted the target radiation chamber 42 with an inlet pipe 40 for sealingly engaging the electron beam delivery pipe 28 (FIGS. 6(A) and 6(B)). A cooling tower component. 32 is sealingly engaged with the target radiation chamber 42 directly above the radiation chamber wherein a target holder is mounted during the radiation process. A vacuum pipe 37 and a converter station cooling assembly 34 are sealingly mounted to the side of the target radiation chamber 40 (FIGS. 6(A) and 6(B)). The cooling tower component 32 comprises a coolant tube housing 44 that is sealingly engaged at its distal end to a coolant tube cap assembly 45 with a plurality of nuts 45*a*. The coolant tube cap assembly is provided in this example with rods 48 for remote-controlled engagement by a crane (not shown) for lifting and separating the cooling tower component 32 from the target radiation chamber 42 (FIGS. 7-9). A coolant water supply tube 100 (FIGS. 16(A)-16(C) is housed within the coolant tube housing 44 and communicates with the second cooling water system via the water inlet ingress pipe 46 that is sealingly engaged with the coolant tube cap assembly 45.

Figure 16:
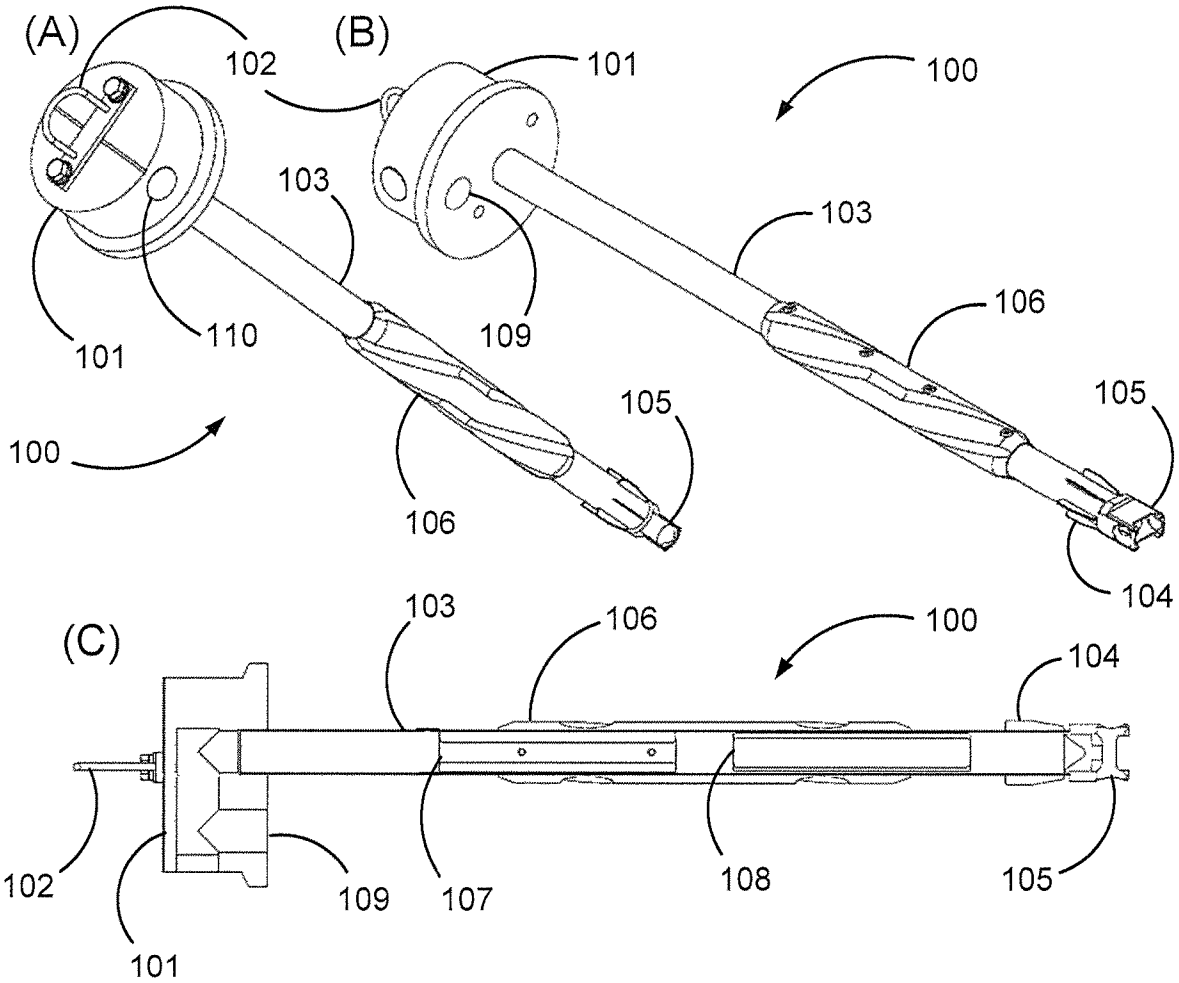
FIG. 16(A) is a perspective view from the top of an exemplary cooling tube component, while 16(B) is a perspective view from the bottom of the cooling tube component, and 16(C) is a cross-sectional side view of the cooling tube component.

The cooling water supply tube 100 (FIGS. 16(A)-16(C)) comprises an upper hub assembly 101 at its proximal end, a coolant supply tube 103, a plurality of guide fines 104 at its proximal end, and a cooling tube body holder 105 for releasably engaging a target holder 80. The upper hub assembly 101 is provided with a hook 102 for remote-controlled installation by an overhead crane (not shown) of the cooling water supply tube 100 into and removal from a coolant tube housing 44. An outer shield 106 is provided about the coolant supply tube 103 to position the coolant supply tube 103 within the coolant tube housing 44 and to provide shielding against the bremsstrahlung photon shower that may ingress into the coolant tube housing 44. The outer surface of the outer shield 106 is provided with channels to allow the flow of cooling water therethrough. The coolant supply tube 103 is provided with an inner upper shield 107 and an inner lower shield 108 to provide shielding against the bremsstrahlung photon shower that may ingress into the coolant supply tube 103. Cooling water is delivered from the second cooling water supply system through the water inlet ingress pipe 46 into the proximal end of coolant supply tube 103 through an ingress port (not shown) in the upper hub assembly 101 and is delivered out of the distal, end coolant supply tube 103 through cooling tube body holder 105 and then circulates back to the upper hub assembly 101 in the space between the outside of coolant supply tube 103 and the inside of coolant tube housing 44 and then egresses the cooling water supply tube 100 through ports 109, 110 provided in the upper hub assembly 10. The coolant supply tube 103 is provided with a plurality of fins 104 about its outer diameter approximate the cooling tube body holder 105 and function as a guide for remote-controlled installation of the cooling water supply tube 100 into and removal from a coolant tube housing 44, by an overhead crane (not shown). The coolant tube housing 44 is provided with a coolant tube alignment assembly 47 to enable precise alignment of the cooling water supply tube 100 within the coolant tube housing 44. The coolant water supply delivered to and circulated through the target radiation chamber 42 by the cooling tower component 32 is subsequently returned to the second cooling water system.

Figure 11:
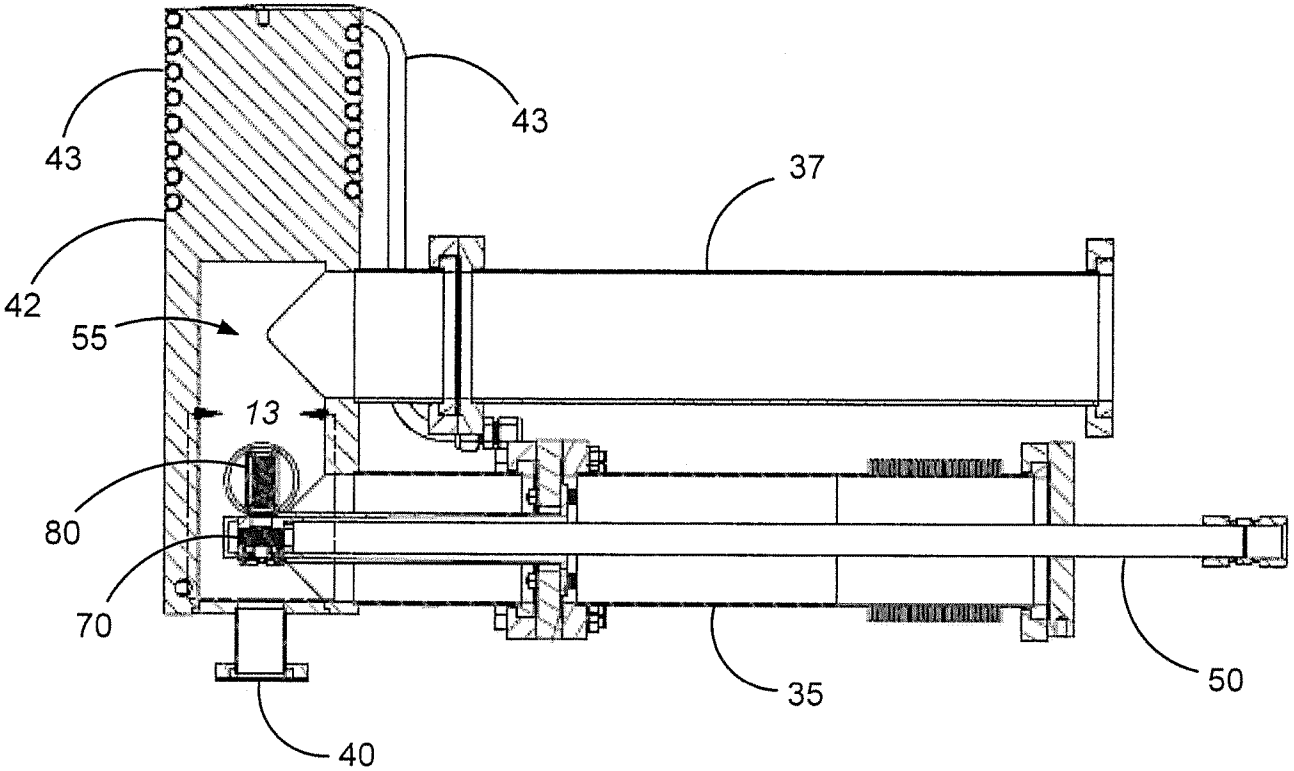
FIG. 11 is a cross-sectional top view of the target drive assembly shown in FIG. 8 showing the energy converter and the target holder mounted in the beamline.
Figure 13:
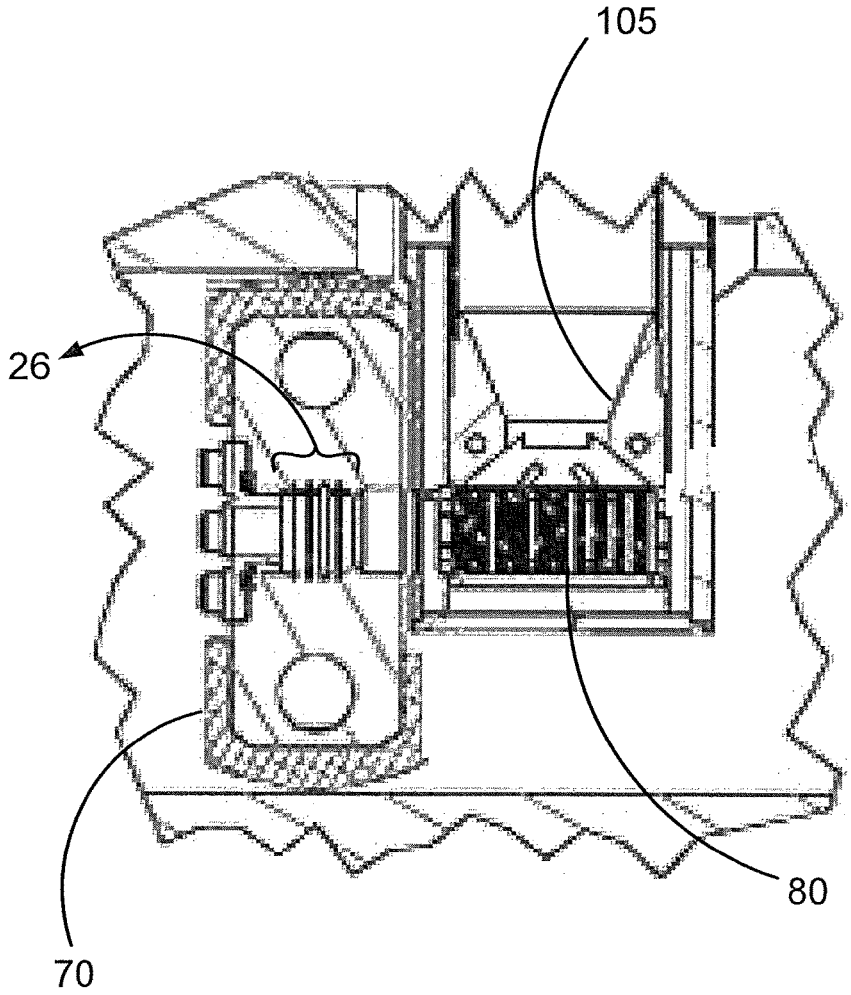
FIG. 13 is close-up cross-sectional front side view from FIG. 9 showing the energy converter and the mounted target holder.
Figure 14:
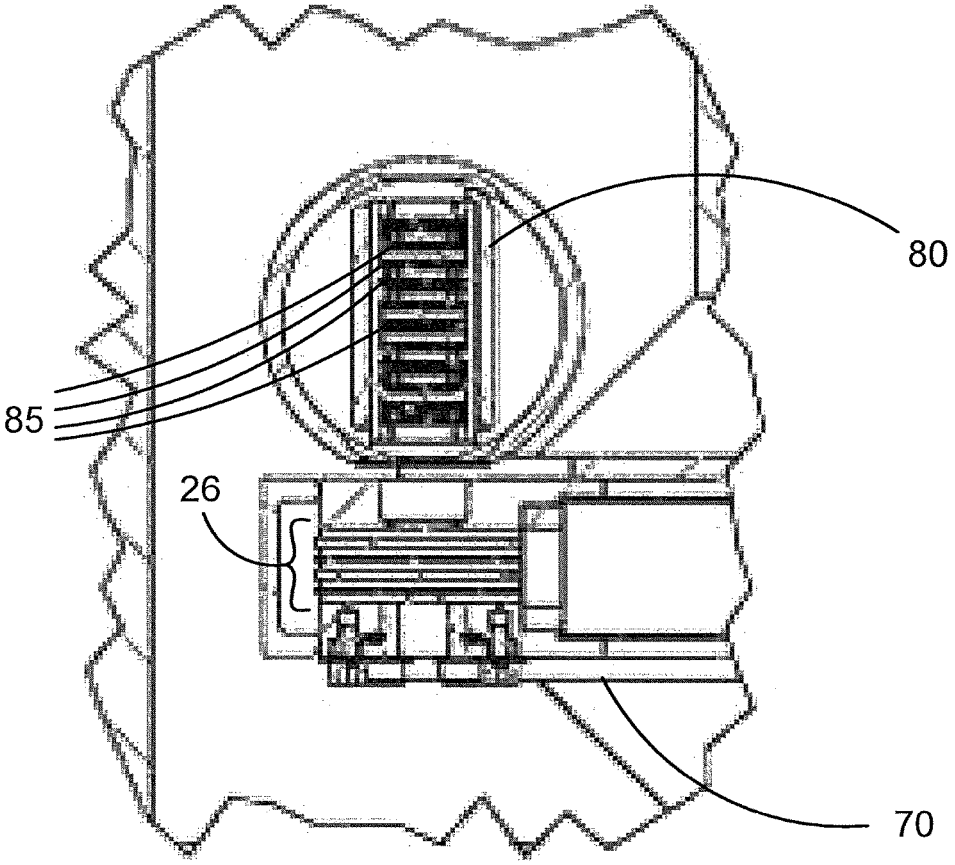
FIG. 14 is a close-up cross-sectional top view from FIG. 11 showing the energy converter and the mounted target holder.

The target radiation chamber 42 has an inner chamber 55 wherein is mounted a bremsstrahlung converter station 70 adjacent to the electron beam inlet pipe 40 (FIGS. 11, 13, 14). The bremsstrahlung converter station 70 is accessible through the converter station cooling assembly 34 that is sealingly engaged with the side of the target radiation chamber 42. The converter station cooling assembly 34 comprises a cooling water pipe 50 receiving a flow of cooling water from the first cooling water system, for circulation to, about, and from the bremsstrahlung converter station 70. The cooling water pipe 50 is housed within a housing 35. Also integrally engaged with the side of the target radiation chamber 42 and communicating with the inner chamber 55 is a vacuum pipe 37 interconnected with a vacuum apparatus 36. After the high-power linac electron beam apparatus 10 has been assembled, the integrity of the beryllium window and its seal in the collimator station 25 and the integrity of a silicon window (alternatively, a diamond window) interposed the inlet pipe 40 and the bremsstrahlung converter station 70 are assessed by application of a vacuum to chamber 55 by the vacuum apparatus 36 via vacuum pipe 37.

Figure 12:
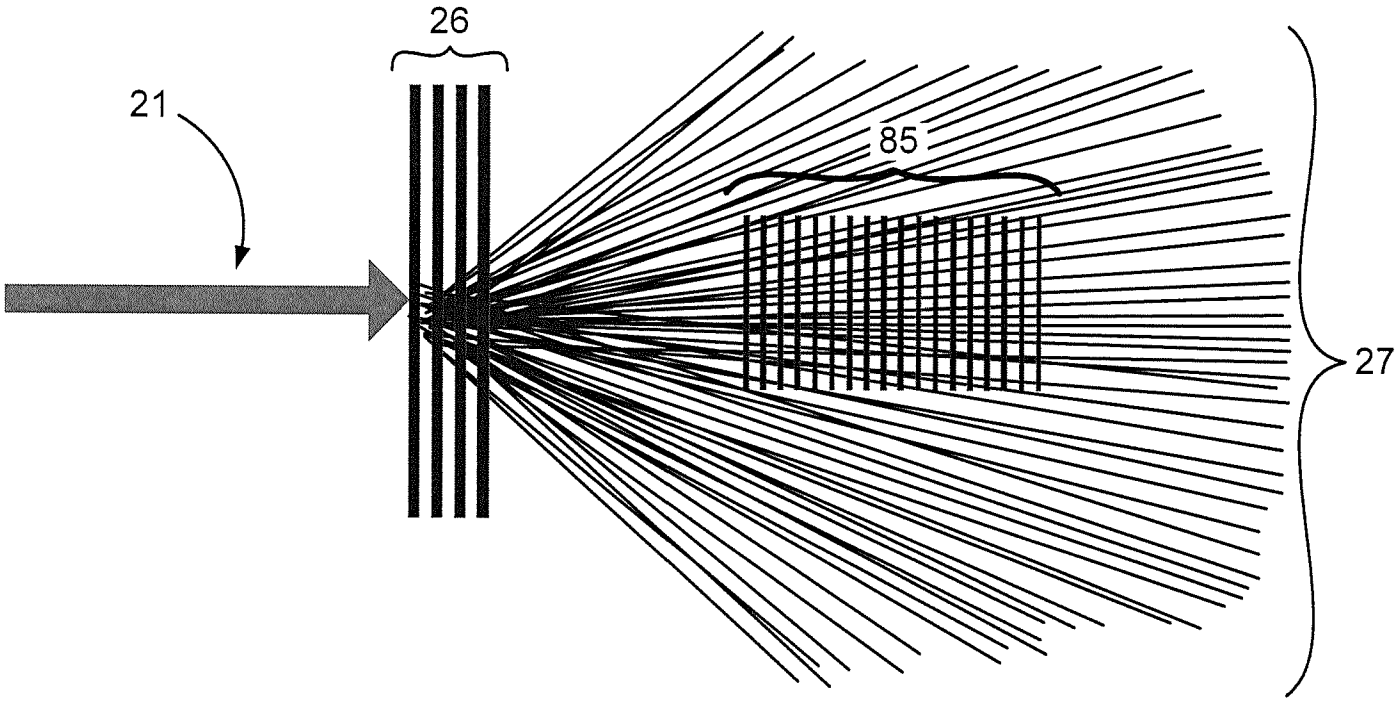
FIG. 12 is schematic illustration of the conversion of a high-power electron beam into a bremsstrahlung photon shower for irradiation of a plurality of $^{100}$Mo targets.

The bremsstrahlung converter station 70 comprises a series of four thin tantalum plates 26 FIG. 12) placed at a 90° angle to the electron beam 21 (FIG. 12) generated by the linac 20. However, it is to be noted that number and/or thickness of the tantalum plates can be changed in order to optimize and maximize photon production generated by the electron beam. It is optional to use plates comprising an alternative high-density metal exemplified by tungsten and tungsten alloys comprising copper or silver. The tantalum plates 26, when bombarded by the high-energy electron beam, convert incident electrons into a bremsstrahlung photon shower 27 (FIG. 12) which is delivered directly to a target holder 80 housing a plurality of $^{100}$Mo target discs 85 (FIGS. 13, 14). It should be noted that converter may be provided with more than four tantalum plates, or alternatively with less than tantalum four plates. For example, one tantalum plate, two tantalum plates, three tantalum plates, five tantalum plates or more. Alternatively, the plates may comprise tungsten or copper or cobalt or iron or nickel or palladium or rhodium or silver or or zinc and/or their alloys. The structure and configuration of the converter station 70 is designed to and to dissipate the large heat load carried by the high-energy electron beam to minimize its transfer to the photon shower to reduce the heat-load transferred to the $^{100}$Mo targets during radiation. Furthermore, the tantalum plates 26 and the target holder 80 housing a plurality of $^{100}$Mo target discs 85 are cooled during the irradiation process by constant circulation of: (i) coolant water through the tantalum plates 26 by the first cooling water system, and (ii) coolant water through the $^{100}$Mo target discs 85 by the second cooling water system.

Figure 15:
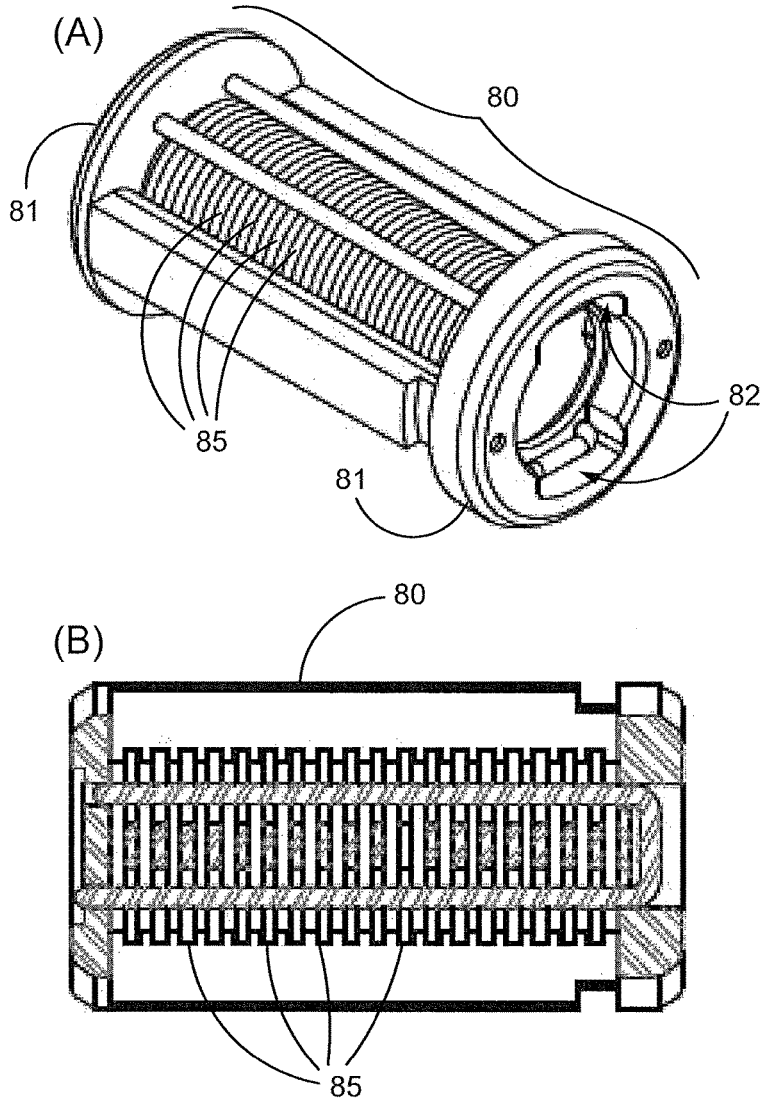
FIG. 15(A) is a perspective view of an exemplary target holder, while 15(B) is a cross-sectional side view of the target holder.

Another embodiment of the present disclosure pertains to target holders for receiving and housing therein a plurality of $^{100}$Mo target discs. An exemplary target holder 80 housing a series of eighteen $^{100}$Mo target discs 85 is shown in FIGS. 15(A) and 15(B). The ends of the target holder 80 are provided with slots for engagement by the cooling tube body holder 105 at the distal end of the coolant water supply tube 103. It is to be noted that suitable target holders for irradiation of $^{100}$Mo targets with the exemplary high-power linac electron beam apparatus 10 of the present disclosure may house in series any number of $^{100}$Mo target discs from a range of about 4 to about 30, about 8 to about 25, about 12 to about 20, about 16 to about 18. Suitable $^{100}$Mo target discs can prepared by pressing commercial-grade $^{100}$Mo powders or pellets into discs and then sintering the formed discs. Alternatively, precipitated $^{100}$Mo powders and/or granules recovered from previously irradiated $^{100}$Mo targets may be pressed into discs and then sintered. It is optional, after $^{100}$Mo powders or pellets are formed into discs, to solidify the $^{100}$Mo materials by arc melting or electron beam melting or other such processes. Sintering should be done in an inert atmosphere at a temperature from a range of about 1200° C. to about 2000° C., about 1500° C. to about 2000° C., about 1300° C. to about 1900° C., about 1400° C. to about 1800° C., about 1400° C. to about 1700° C., for a period of time from the range of 2-7 h, 2-6 h, 4-5 h, 2-10 h in an oxygen-free atmosphere provided by an inert gas exemplified by argon. Alternatively, the sintering process may be done under vacuum. Suitable dimensions for the $^{100}$Mo target discs are about 8 mm to about 20 mm, about 10 mm to about 18 mm, about 12 mm to about 15 mm, with a density in a range of about 4.0 g/cm$^3$ to about 12.5 gm/cm$^3$, 6.0 g/m$^3$ to about 10.0 g/cm$^3$, about 8.2 g/cm$^3$. The end components 81 of the target holder 80 are provided with two or more slots 82 for engagement by the cooling tube body holder 105 of the cooling water supply tube 103, or alternatively, cooling water supply tube 154 (FIGS. 18(A), 18(B)).

FIG. 9 shows a vertical cross-sectional view of an exemplary target holder 80 housing a series of 18 $^{100}$Mo target discs securely engaged within the target radiation chamber 42 for irradiation with a bremsstrahlung photon flux generated by the bremsstrahlung converter station 70. FIGS. 13 and 14 are close-up views from the side and the top respectively, of the target holder 80 secured in place by the body holder component 105 of the cooling water supply tube 100 (FIGS. 16(A)-16(C)) and positioned for irradiation with a bremsstrahlung photon flux.

Figure 17:
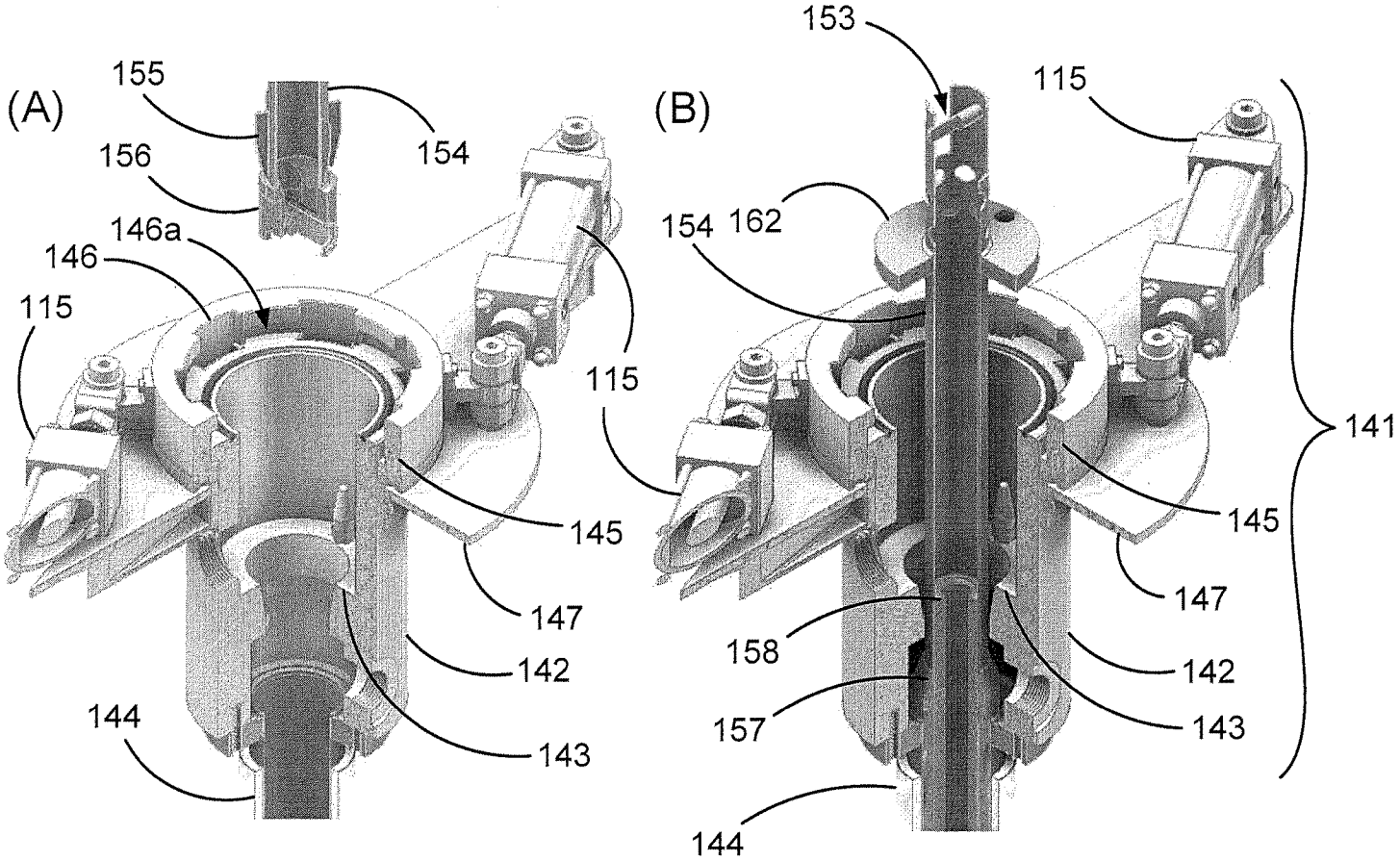
FIGS. 17(A) and 17(B) show another embodiment of a cooling tube component being installed into a target assembly component from FIG. 9.
Figure 18:
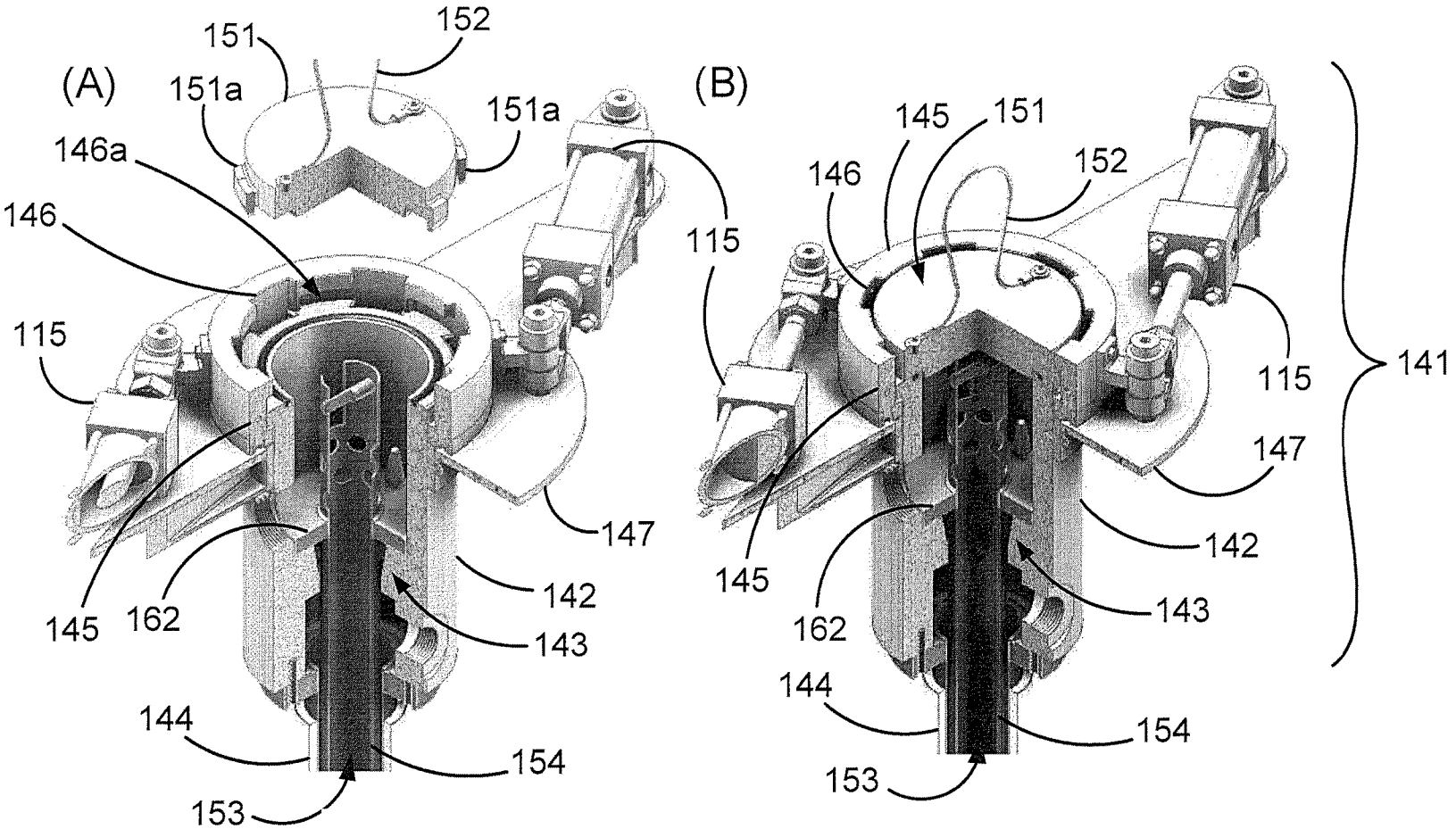
FIGS. 18(A) and 18(B) show the cooling tube component from FIG. 17 being clamped into place within the target assembly component

FIGS. 17 and 18 show another exemplary embodiment of a cooling water supply tube assembly 153 being installed into a coolant tube housing 144. The cooling water supply tube assembly 153 generally comprises a cooling water tube 154 provided with a plurality of cooling tube guide fins 155 about its proximal end, a cooling tube body holder 156 at its distal end (FIG. 17(A)), and a retaining ring 162 approximate its proximal end (FIG. 17(B)). The cooling water supply tube 154 has an outer shield 157, an inner upper shield 158 (FIG. 17(B)), and an inner lower shield (not shown). The upper end of the coolant tube housing 144 is provided with a coolant tube cap assembly 141 comprising a coolant tube cap body 142 integrally engaged with the upper end of the coolant tube housing 144 (FIGS. 17 and 18). The coolant tube cap body 142 has an integral shoulder portion 143 for seating thereon the coolant tube retaining ring 162 (FIGS. 18(A) and 18(B)). The coolant tube cap assembly 141 also comprises a flange 147 interposed the coolant tube cap body 142 and a collar 145 integrally engaged with the top of the coolant tube cap body 142. The coolant tube cap collar 145 has a plurality of vertical channels 146 provided around its inner diameter, with each vertical channel 146 having a contiguous horizontal side channel 146*a* (FIG. 17(A)). Also provided is a coolant tube cap 151 for sealing engaging the coolant tube cap collar 145 after a cooling water supply tube assembly 153 is installed into the coolant tube housing 144 (FIGS. 18(A), 18(B)). The coolant tube cap 151 has a plurality of outward-facing lugs 151*a* spaced around its side wall for slidingly engaging the vertical channels 146 and horizontal side channels 146*a* of the coolant tube cap collar 145. A coolant tube cap lifting loop 152 is secured to the top of the coolant tube cap 151 for releasable engagement by a crane hook 266 that is manipulated by remote-controlled operation of a molybdenum handling apparatus (FIGS. 19(A), 19, 23).

Another exemplary embodiment of the present disclosure relates to a remote-controlled molybdenum handling apparatus for transferring target holders loaded with a plurality of Mo target discs into a target assembly station for irradiation with a high flux of high-energy bremsstrahlung photons, recovering irradiated target holders from the target assembly station, transferring and sealing the irradiated target holders into a lead-shielded cask, and then transferring the lead-shielded cask into a conveyance apparatus for removal from the linac irradiation facility. The remote-controlled molybdenum handling apparatus 200 is also used for inserting and recovering the cooling water supply tube assembly into and out of the target assembly station.

Figure 19:
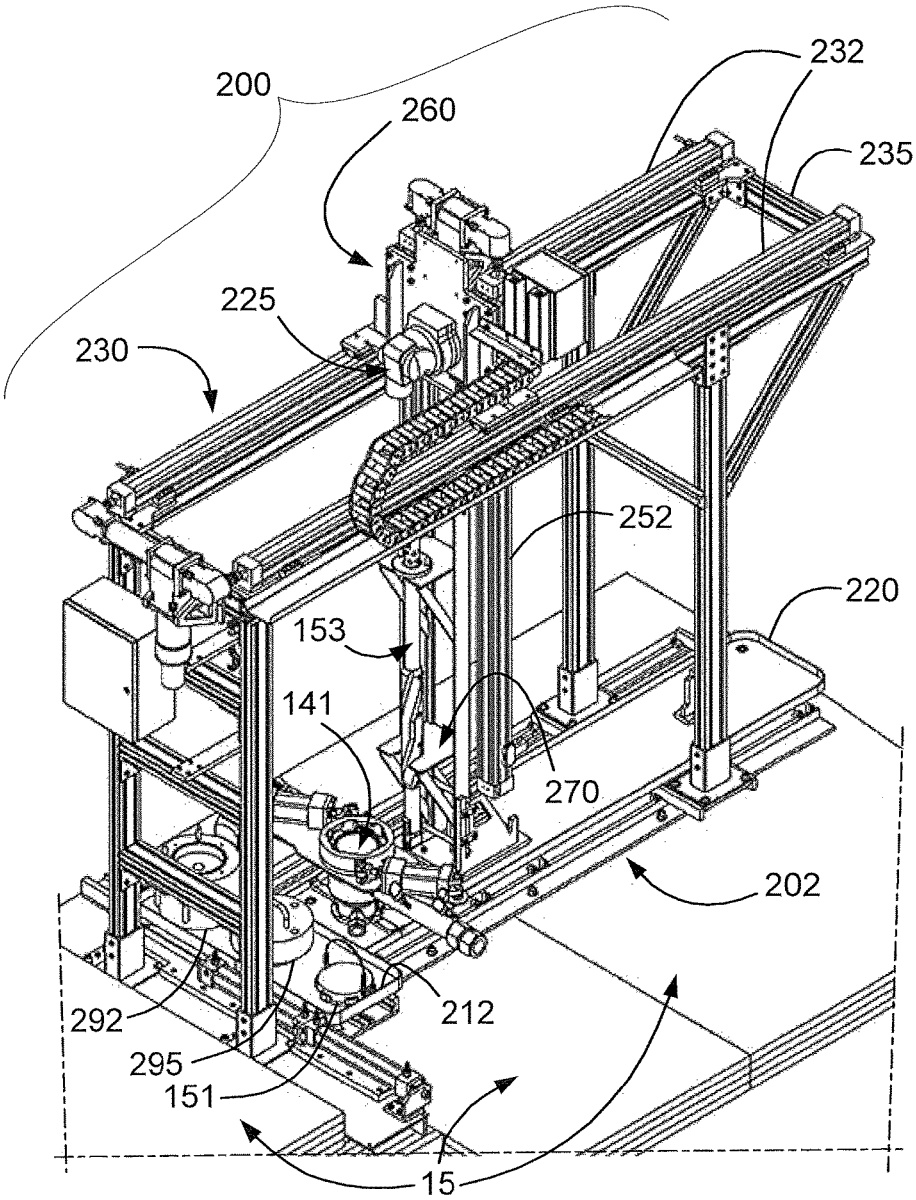
FIG. 19 is a perspective view of an exemplary remote-controlled molybdenum handling apparatus mounted onto the protective shield cladding of the target assembly station component of the exemplary system shown in FIG. 1.
Figure 23:
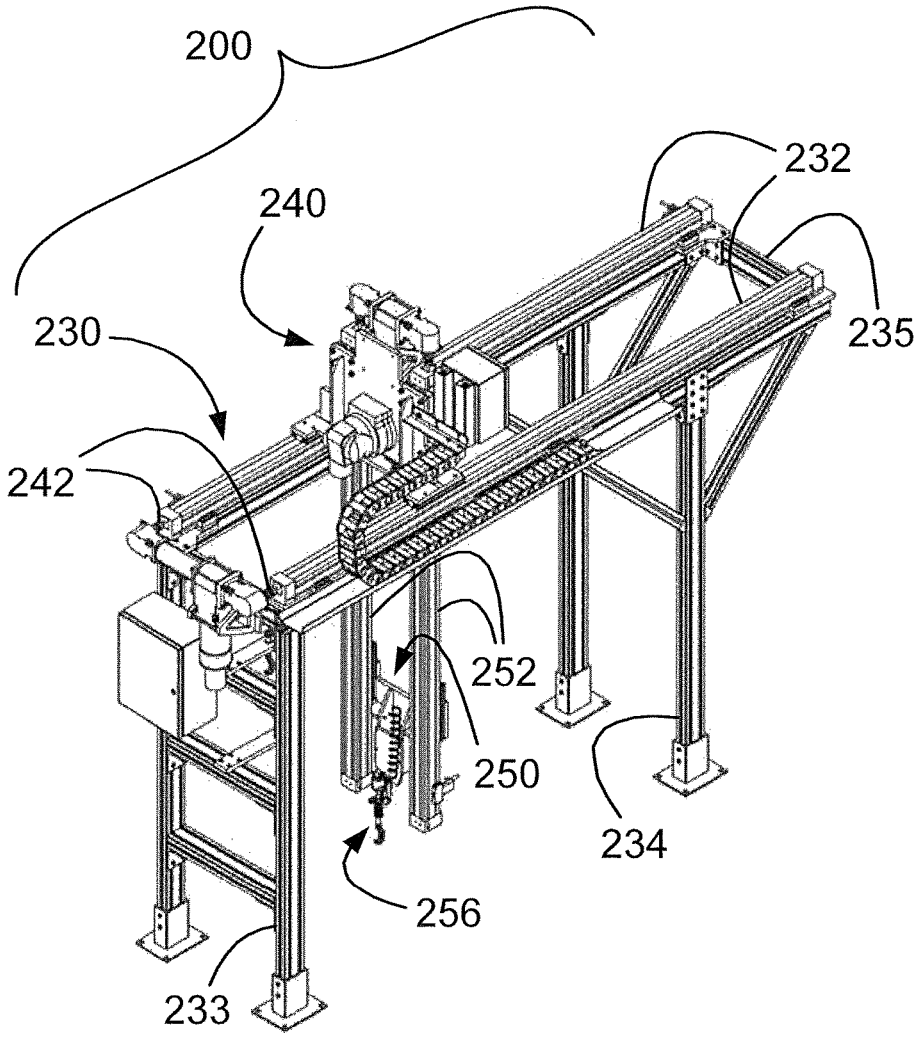
FIG. 23 is another perspective view of the exemplary remote-controlled molybdenum handling apparatus shown in FIG. 19.

A suitable exemplary remote-controlled molybdenum handling apparatus 200 is shown in FIGS. 19, 23 and generally comprises a framework 230 onto which is mounted a "X"-carriage assembly 240 for remote-controlled conveyance of a "Z"-carriage assembly 250 in a horizontal plane. The Z-carriage assembly 250 moves a grapple assembly 256 (FIGS. 24(A), 24(B)) in a vertical plane. The remote-controlled molybdenum handling apparatus 200 is mounted onto a frame support base 202 (FIG. 20) which in turn, is secured onto the protective shield cladding 15 (FIG. 19) encasing the target assembly station component 30 of the exemplary system 10 shown in FIG. 1. The framework 230 of the remote-controlled molybdenum handling apparatus 200 is fixed to the frame support base 202 (FIG. 20) and comprises two main support elements in the form of, for example, fabricated stainless inverted tee rails 203 having a mounting hole pattern matching the target chamber shielding bolt holes (not shown). The tee rails 203 run parallel to the linac and rest on top of the protective shield cladding 15, and are bolted down into steel blocks (not shown) underlying the protective shield cladding 15 and encasing the target assembly station component 30. Several cross bars 204 span the two support tee rails 203 to provide structural support. The end closest to the linac has a fabricated structural channel 206 which supports one end of the framework 230 and the stationary end of the shuttle tray pneumatic cylinder 209. Mounting plates 208 for the other end of the framework 230 are located farther along the support tee rails 203. A shuttle guide rail 210 is bolted to a backing plate (not shown) which in turn, is bolted across the support tee rails 203. The shuttle guide rail 210 vertically supports and horizontally guides the linear motion of the shuttle tray 212 perpendicular to the main support tee rails 203. A long drip tray 220 is also supported on several of the cross bars 204. The drip tray 220 serves to collect and contain any contaminated cooling water that may drip from the cooling tube assembly or flow chamber lid as they are being handled (as will be described later). The drip tray 220 is fabricated in two pieces to allow assembly around a port 222 that provides access to the cooling tower 32 station of the target assembly 30 (shown in FIGS. 4, 5). The joint and opening around the port 222 are dammed and sealed to minimize leaks. Each end of the drip tray 220 is equipped with a bottom drain point connected to a capped elbow (not shown). Temporary drain hoses may be attached to these elbows to collect effluent from decontamination fluids. The drip tray 220 is provided with four pins that serve as the demountable mounting point 219 for the tipping tower assembly (reference 270 in FIG. 25) and with a tipping tower rest 221. As used herein, the term "demountable" means that a component, for example a tipping tower assembly, may be temporarily secured to a mounting point and then later, unsecured and removed.

Figure 24:
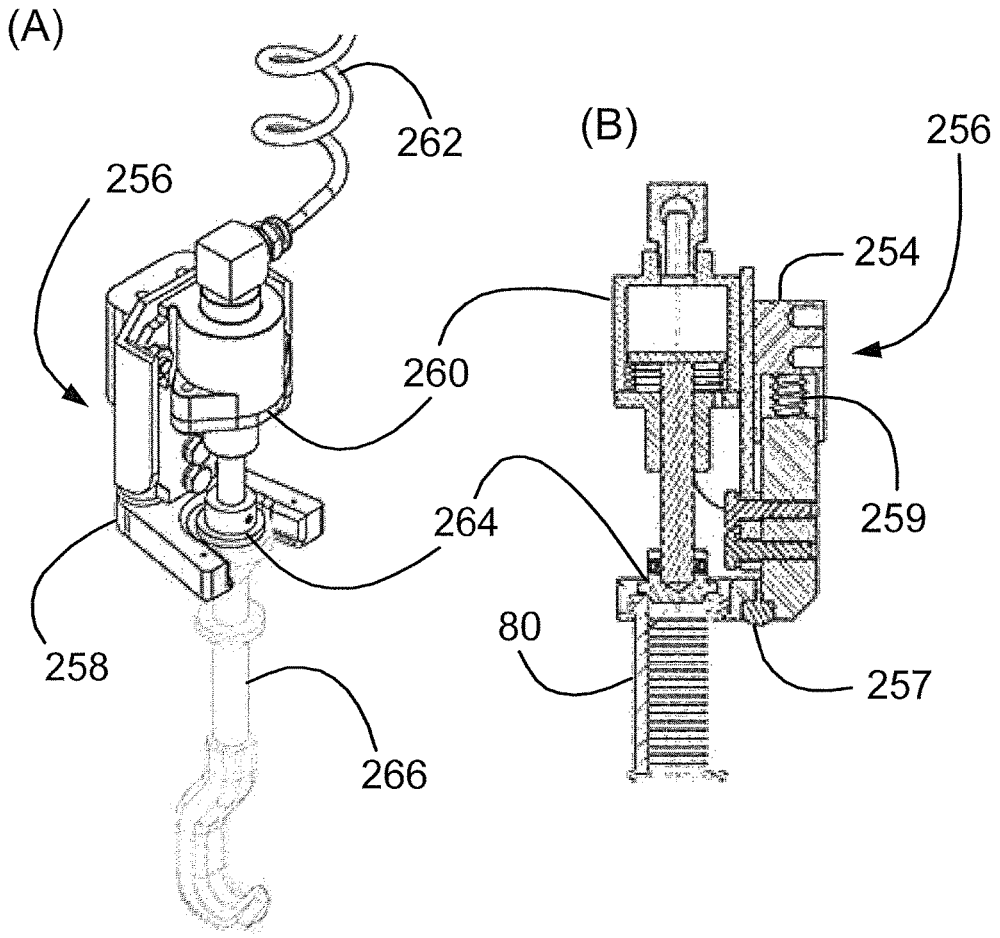
FIG. 24(A) is a perspective view of an exemplary grapple component from the exemplary remote-controlled molybdenum handling apparatus shown in FIGS. 19 and 23, shown engaged with a crane hook, while FIG. 24(*b*) is a cross-sectional side view of the exemplary grapple component shown engaged with an exemplary molybdenum target holder.

The shuttle tray 212 (FIG. 21) may be, for example, in the shape of a formed and welded stainless steel pan about 700 mm long×250 mm wide×30 mm deep. The shuttle tray 212 is equipped with (a) four-stud mounted track rollers (not shown) for vertical support during motion, and (b) two track rollers (not shown) to maintain horizontal alignment during motion. The shuttle tray 212 securely positions and laterally transports the shield cask base 292 on vertical dowels 214, shield cask lid 295 (FIG. 23) in receptacle 216, and the coolant tube cap 151 (FIGS. 18(A), 18(B)) in receptacle 281, into position underneath the remote-controlled molybdenum handling apparatus 200 for further remote handling. The shield cask 290 is manually set on (and retrieved from) the shuttle tray 212 prior to the beginning and after the end of the remote handling operations. The two vertical dowels 214 are used to align and stabilize the shield cask base 292 on the shuttle tray 212. The shield cask lid 295 and coolant tube cap 151 are both remotely removed and installed on the shield cask base 292 or coolant tube housing 145, respectively, by remote-controlled molybdenum handling apparatus 200 with a crane hook 266 engaged by the grapple assembly 256 (FIGS. 23, 24). The shuttle tray 212 slightly overlaps the end of the drip pan 208 to ensure a continuous collection path for possible drips of contaminated water that may occur during recovery and handling of a cooling tube assembly 153 after irradiation of a loaded target holder 80. The shuttle tray 212 is also equipped with a bottom drain port 213 and capped elbow for future drainage of decontamination fluids. The shuttle tray 212 is moved by two 10.0" stroke×1.5" bore heavy duty pneumatic cylinders 209 bolted together in a back-to-back arrangement. Bolting two cylinders back to back to achieve three possible positions allows for two unique cylinder configurations to achieve the center position. The coolant tube cap receptacle 218 position is achieved with both cylinders extended. The shield cask lid receptacle 216 position is achieved with either cylinder extended and the shield cask base 214 position is achieved with both cylinders retracted.

The remote-controlled molybdenum handling apparatus 200 is the primary remote handling mechanism for transferring target holders 80 loaded with 100Mo target discs into and out of the cooling tower 32 station of the target assembly 30 by providing all of the beam paths for horizontal (X) and vertical (Z) motion to the remotely handled components. The remote-controlled molybdenum handling apparatus 200 is equipped with a grapple assembly 256 provided with a pneumatic clamping tip 264, a downward looking camera 225 and twin light emitting diode (LED) spot lights (not shown) for overhead viewing and illumination of the work area within and about the remote-controlled molybdenum handling apparatus 200.

The exemplary framework 230 is a four legged structure bolted to the frame support base 202. The framework 230 may be built from extruded aluminum structural framing components. The framework 230 has two main beams 232 running parallel to the linac, which are braced together at each end to maintain accurate spacing and provide structural rigidity. The beams and braces provide support to the X-drive motor and gearboxes, a cable carrier, electrical conduits and a junction box. In the exemplary embodiment shown in FIGS. 19 and 23, the two main beams 232 directly supporting the two X drive linear actuators are located about 440 mm apart. The X-carriage 240 is mounted between X-drive linear actuators 242. The X-carriage 240 supports the motor, gearboxes and linear actuators of the Z-carriage 250 as well as the LED spot lights and camera 225. The vertical Z-drive actuators 252 are spaced about 270 mm apart to fit between the X-drive actuators 242 and to provide adequate clearance between the Z-drive actuators 252 for remote handling operations performed on the tipping tower assembly 270 (see FIG. 25). The Z-carriage 250 supports the grapple assembly 256.

Suitable linear actuators for both the X-drive and the Z-drive are a ballscrew-driven internal profile rail-guided style. Each unit consists of a square extruded aluminum body equipped with an internal recirculating ball carriage with an integral ballnut riding an internal rail driven by a 5-mm pitch rotating ballscrew. The external load carriage is attached to the internal guided carriage through a stainless steel cover band to protect the internal drive components from splash water and dust. The actuators and the gearboxes are factory lubricated with a proprietary radiation resistant polyphenol polyether based grease. Both the X and Z motions are driven (powered) on both of their linear actuators to prevent jamming of the fabricated X and Z carriages. The X and Z drive motors are each a radiation hardened stepper motor equipped with a fail-safe (spring applied, power to disengage) brake and a brushless resolver. Resolvers are provided for this environment as the read discs of optical encoders are prone to browning and premature failure in high radiation fields. Each motor output drive shaft is connected to a tamper-proof torque limiting safety coupling to prevent mechanical overload of the drive components. The X-drive torque limiter is rated at 1.13N·m (10 in·lbs) of torque and the Z-drive torque limiter is rated at 2.26N·m (20 in·lbs) of torque. If tripped (disengaged), the torque limiters will automatically attempt to reengage upon every motor shaft revolution. Once the overload is removed and the speed is reduced they will reengage. As the torque limiters are bidirectional and are rated beyond the heaviest payload of the manipulator, they will not allow a hoisted payload to descend in an uncontrolled fashion if they disengage during hoisting. They are not a friction style limiter so no adjustment is ever required. Motor speed is infinitely adjustable via the joystick control from zero up to a maximum set speed of about 300 revolutions per minute (rpm). With a ballscrew pitch of about 5 mm and all gear ratios at about 1:1, this provides a maximum linear actuator speed of about 25 mm/sec. On both the X and Z drives, the safety overload coupling is attached to the input shaft of a dual output shaft gearbox. A right angle gearbox is coupled to each end of the dual output gearbox. The output shaft of each right angle gearbox is coupled to the input shaft of the linear actuator through a coupling. As the dual output gearbox is a solid shaft, one output shaft rotates clockwise with respect to the mounting face and the other rotates counterclockwise. As a result, the linear actuator pairs consist of a right hand threaded ballscrew and a left hand threaded ballscrew. Each pair of linear actuator ballscrews is matched in pitch over their travel length to about 0.04 mm which is less than the free play in the shaft end bearing. This match prevents the two driven screws from binding against each other when joined through the rigid X or Z fabricated carriage.

The total travel range for the linear actuators is about 1850 mm in the X direction and about 1250 mm in the Z direction. However, proximity detectors are placed near the ends of travel to prevent running the internal actuator carriages into their ends. Hence, the actual travel range is approximately 1800 mm and 1200 mm for the X and Z motions respectively. The near X and high Z proximity detector positions are set as the home position of the remote-controlled molybdenum handling apparatus 200 for re-zeroing the resolver readouts. All remote handling motions are monitored by closed circuit television camera from a minimum of two camera views e.g., overhead and orthogonal, to ensure correct positioning, alignment and engagement of the remote-control operated equipment.

Spotlights may be provided, for example twin LED spotlights, to enhance operators' ability to perceive depth through use of shadows. To enable this, each light is individually controlled. The cameras are network enabled color cameras featuring pan, tilt and zoom capabilities.

The grapple assembly 256 (FIG. 24) is a miniature custom engineered lifting device that engages and lifts with its pneumatic clamping tip 264 either the target holder 80, or the crane hook 266 and its payload. Engagement with either of these two components occurs first in the horizontal direction of motion to center the component in the grapple's pneumatic clamping tip 264, then in the vertical direction to contact and lift the component. To enable centering in the horizontal direction, the grapple framework 258 is fork-shaped with two tapered prongs leading to a semi-circular open ring. The prongs and ring have a lip on their lower edge. This lip engages the underside of a flat surface provided on both lifted components.

As this exemplary embodiment does not have any vertical features on the lip of the grapple framework 258 to resist horizontal sliding of a lifted component, the grapple is equipped with a spring retract pneumatic clamping cylinder 264 that inserts a plunger tip into a matching recess in the top of either of the lifted components. The plunger tip enters this recess and exerts a force of approximately 175 N (40 lbf) to ensure the lifted component does not slip out of the grapple during operations. When the lock plunger is engaged, the component is effectively locked to the grapple. However, to avoid a trapped component on the grapple, the spring retract plunger will automatically retract upon removal of the air supply to it. Inadvertent loss of air would also retract the plunger but this does not equate to a dropped component it simply means the component could slide forward out of the grapple if sufficient horizontal forces were developed though impact or rapid deceleration. The clamping cylinder also provides a degree of mechanical compliance in the horizontal direction when operating the hook adapter. The conical shape surrounding the flat engagement portion on the hook adapter allows it to rock in the forward and back direction on the grapple. Slight rocking is necessary when traversing the arc trajectory required for the tipping tower operation. The plunger allows this rocking motion without disengagement.

To assist with horizontal motion, the grapple assembly 256 may be equipped with three miniature ball transfer units 257 on the bottom of the grapple body. These ball transfer units 257 allow the grapple assembly 256 to be rolled along a surface when moved in the horizontal direction. Ideally, the grapple assembly 256 is lowered until the ball transfer units 257 lightly physically contact the appropriate mating surface for the component to be acquired. They then act as a positive downward stop. However, as the manipulator is not equipped with any force feedback, and all operations are under remote control, a degree of vertical mechanical compliance is built into the grapple. The upper body of the grapple assembly 256, which is attached to the bottom of the Z-carriage 250, is bolted to the lower body of the grapple framework 258 through a spring-loaded sliding sleeve 254 (springs 259). This sliding-sleeve arrangement allows about 10 mm of over travel in the vertical downward direction without overloading the Z-drive and causing the safety torque limiter to inadvertently disengage. This also limits the force on the ball transfer units 257 to allow smooth horizontal rolling motion. The springs 259 only allow over travel in the downward direction, they do not form part of the lifted load path.

Figure 25:
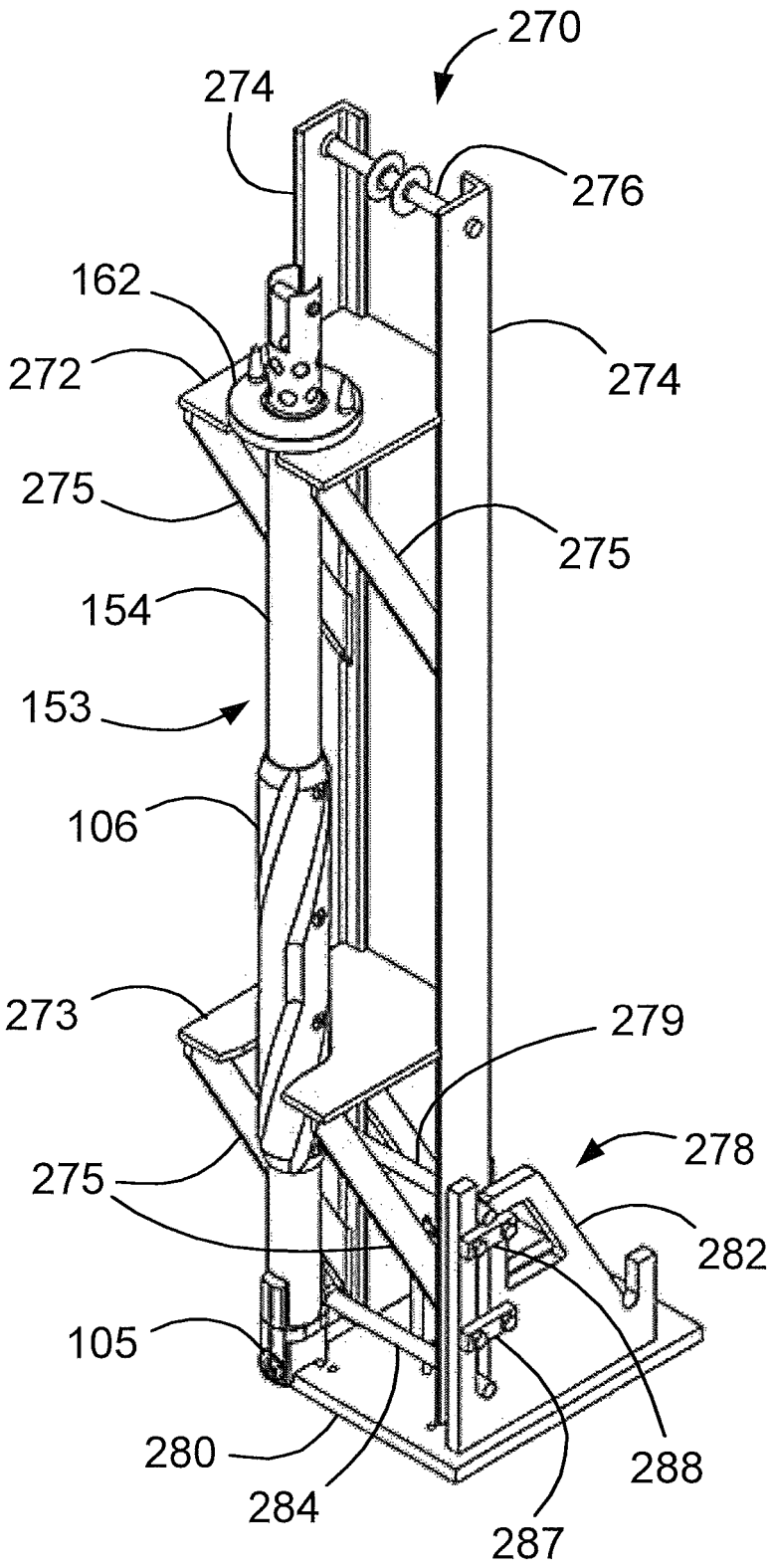
FIG. 25 is a perspective view of an exemplary tipping tower for demountable engagement with the exemplary remote-controlled molybdenum handling apparatus shown in FIGS. 19 and 23, wherein the exemplary tipping tower is configured for receiving and holding a cooling tube assembly.
Figure 26:
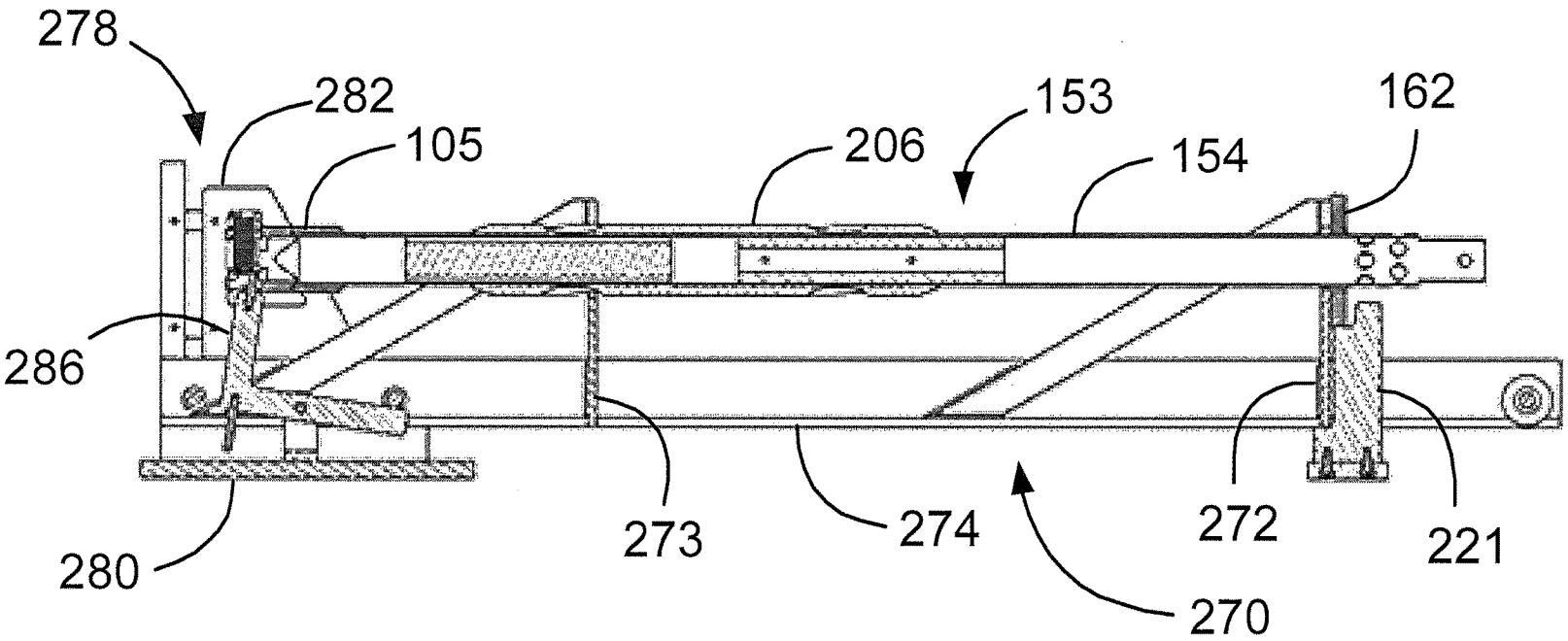
FIG. 26 is a horizontal cross-sectional view of the exemplary tipping tower shown in FIG. 25.

Another exemplary embodiment of the present disclosure pertains to a tipping tower is both a piece of remote handling equipment and a piece of equipment that is remotely handled. A suitable exemplary tipping tower assembly 270 is shown in FIGS. 25, 26, and generally comprises the tower weldment, a pivot guide base with a lever arm assembly, and a tower rest assembly. The tipping tower assembly 270 is used for supporting a cooling tube assembly 153 carrying a target holder 80 while the cooling tube assembly 153 is pivotably lowered from a vertical position to a horizontal position and orientated as necessary by rotation with the grapple assembly 256 within the remote-controlled molybdenum handling apparatus 200. Rotation of the target holder 80 is necessary to orientate it (i) vertically for insertion into and removal from the shield cask 290, and (ii) horizontally for insertion into and removal from the cooling tube assembly 153 engaged with the tipping tower assembly 270 after the tipping tower assembly 270 has been pivotably lowered into a horizontal position.

The tipping tower assembly 270 comprises a tipping tower weldment pivotably engaged with a pivot guide base. A suitable exemplary tipping tower weldment (best seen in FIG. 25) comprises a pair of elongate angle bars 274 spaced apart by an upper support plate 272 and a lower support plate 273. The support plates 272, 273 are structurally strengthened in place with support braces 275. The upper support plate 272 and lower support plate 274 are provided with matching tapered slots having arcuate ends for receiving and positioning therein the cooling tube assembly 153. The cooling tube assembly 153 is supported on the upper support plate 272 by placing and resting thereon the coolant tube retaining ring 162 of the cooling tube assembly 153. The lower support plate 273 provides the necessary second point of support to the cooling tube assembly 153 when it is in the horizontal orientation. The tipping tower weldment has three round bars passing between the two main support angles. The upper round bar 276 (also referred to as the upper round shaft) is engageable with the crane hook 266 in cooperation with the grapple assembly 256, for raising and lowering the tipping tower assembly 270. The upper round bar 276 is provided with two tapered discs positioned about the centre of the bar 276 for guiding the crane hook 266 into position. The bottom round bar 284 (referred to as the bottom round shaft) serves the pivot point for lowering the tipping tower assembly 270 into a horizontal position. The intermediate round bar 279 (also referred to as the intermediate shaft) acts as a stop when the tipping tower assembly 270 is raised to the vertical position and as an activating mechanism for the lever arm 286 (FIG. 26) when tipping tower assembly 270 is lowered to the horizontal position. The ends of the bottom round bar 284 and the intermediate round bar 279 extend through the sides of the elongate angle bars 274.

The tipping tower assembly 270 is provided with pivot guide base that cooperates with the tipping tower weldment to pivotably lower the tipping tower assembly 270 into a horizontal position and to pivotably raise the tipping tower to a vertical position. The pivot guide base has a bottom plate 284 to which is securely fixed a pair of matching spaced-apart side plates 282. The side plates 282 are provided with: (i) a sloped top edge receding downward from a first side end to the opposite side end, (ii) matching vertical guide slots that are parallel to and adjacent to the "long" side ends of the side plates 282, (iii) matching vertical guide slots that are parallel to and adjacent to the "short" side ends of the side plates 282, (iv) matching lower crossbars 287 fixed across the matching vertical guide slots adjacent to the "long" side ends of the side plates 282 at a selected first position above the bottom plate 284, and (v) matching upper crossbars 288 fixed across the matching vertical guide slots adjacent to the "long" side ends of the side plates 282 at a selected position above the lower crossbars 287. The ends of the bottom round bar 284 extending outward from the elongate angle bars 274 also extend outward through the matching vertical guide slots adjacent to the "long" side ends of the side plates 282 between the lower crossbars 287 and upper crossbars 288. The ends of the intermediate round bar 279 extending through the sides of the elongate angle bars 274 also extend outward through the matching vertical guide slots adjacent to the "long" side ends of the side plates 282 above the upper crossbars 288. A lever arm assembly 286 is pivotably mounted to the bottom plate 284.

Figure 20:
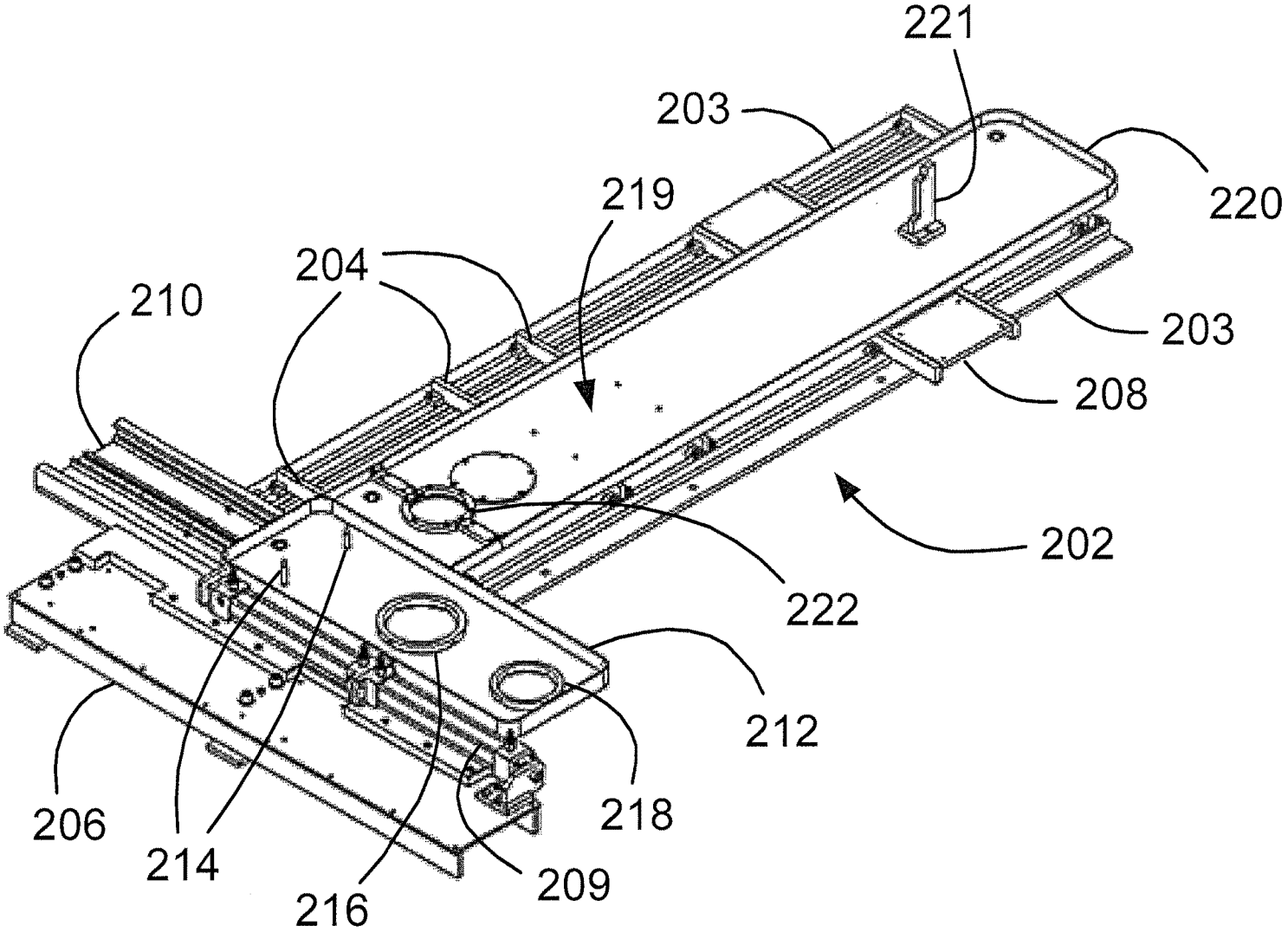
FIG. 20 is a perspective view of an exemplary frame support base for the exemplary remote-controlled molybdenum handling apparatus shown in FIG. 19.

The slots on the side plates 282 trap, guide and position the ends of the bottom round bar 284 and intermediate round bar 279 that extend outward through the sides of the elongate angle bars 274. In the vertical orientation, the ends of the bottom round bar 284 are trapped in the "long" vertical guide slots between the lower crossbars 287 and the upper crossbars 288, while the end of the intermediate round bar 279 are trapped within the "long" vertical guide slots above the upper crossbars 288 thus keeping the tipping tower assembly 270 upright. During operation wherein a cooling tube assembly 153 is mounted into and onto the tipping tower assembly, the bottom plate 284 of the pivot guide base is mounted onto the four pins on the drip tray that serve as the mounting point 219 (see FIG. 20) for the tipping tower assembly 270. When it is desired to move the tipping tower assembly 270 from a vertical to horizontal position, or vice versa, the upper round bar 276 is engaged by a crane hook 266 attached to the grapple assembly 256 of the remote-controlled molybdenum handling apparatus 200. The tipping tower assembly 270 may be lifted until the outward-extending ends of the bottom round bar 284 abut against the upper cross bars 288. In this position, the outward-extending ends of the intermediate round bar 279 will have moved out of the "long" vertical slots in side plates 282. As a consequence of remote control of the molybdenum handling apparatus 200, the tipping tower assembly 270) will be pivotably towered from the vertical position to a horizontal position by remote controlled movement of the grapple assembly 156 in a horizontal plane long the frame support base 202 white concurrently lowering the top of the tipping tower assembly 270 so that the outward-extending ends of the intermediate round bar 279 slides along the sloped top edge receding downward from the first side end to the opposite side end of the side plates 282 thereby pivotably towering the top of the tipping tower assembly 270. When the outward-extending ends of the intermediate round bar 279 reach the end of the sloped top edge of the side plates 282, they are stopped by engagement with the "short" vertical slots in side plates 282. In a fully lowered position, the tipping tower assembly 270 is supported by engagement of its upper support plate 272 with the tipping tower rest 221 provided on the drip tray (FIGS. 20, 26). As the top of the tipping tower assembly 270 is pivotably lowered, the portion of the intermediate round bar interposed the elongate angle bars 274 presses down on one end of the lever arm 286 causing the other end of the lever arm 286 to elevate. The raising end of the lever arm 286 is provided with a rounded extension tip (not shown) that contacts a target holder 80 engaged by the coolant tube assembly 153, and raises it a few millimeters to enable the pneumatic clamping tip 264 of the grapple assembly 256 to properly engage the target holder 80 for its removal from the coolant tube assembly 153.

Operation of the high-power linac electron beam apparatus 10 of the present disclosure generally comprises the following steps.

Figure 21:
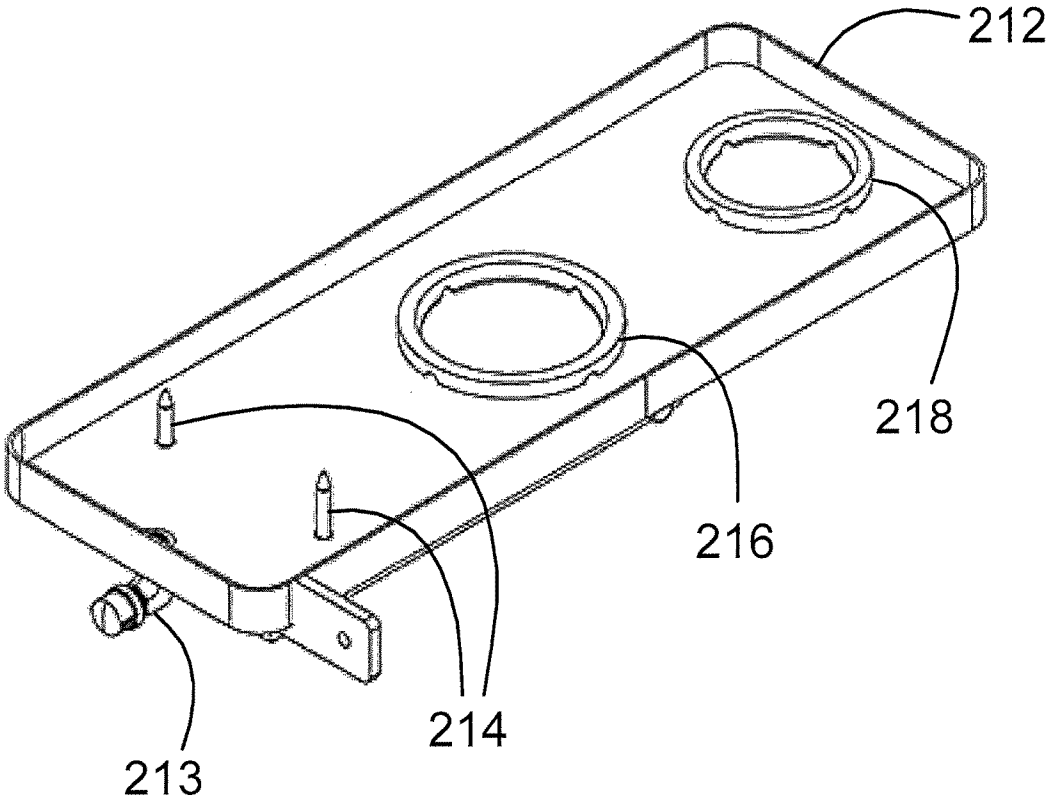
FIG. 21 is a perspective view of an exemplary shuttle tray that cooperates with the exemplary frame support base shown in FIG. 20.
Figure 22:
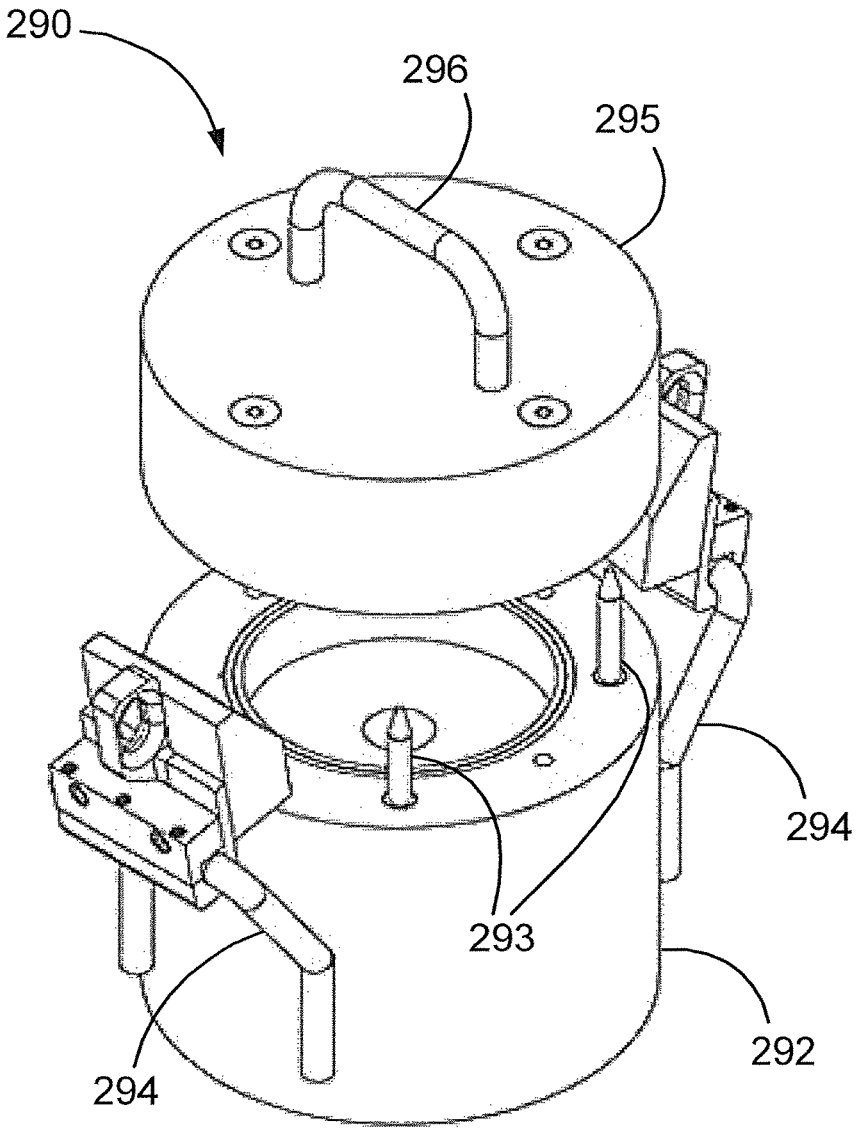
FIG. 22 is a perspective view of an exemplary shield cask that is mountable onto the exemplary shuttle tray shown in FIG. 21.

The first step is to prepare molybdenum-100 target discs for loading into the target holder 80. The molybdenum discs may be prepared from naturally occurring molybdenum powder (9.6% Mo-100 isotopic abundance) or from highly enriched Mo-100 powder. The Mo-100 powder may be finely ground or otherwise conditioned prior to dispensing and placement into a disc-forming die. The die is placed into a hydraulic press and the discs are pressed. The pressed discs are nominally about 15 mm in diameter and about 1 mm thick. Subsequent sintering at high temperatures in a reducing or inert atmosphere furnace causes the discs to shrink by approximately 4% in diameter and 3% in thickness. After pressing and sintering, the individual target discs are manually loaded into the target holder 80 and the loaded target holder 80 is manually loaded into a lead-lined shield cask 290. Handling of the Mo-100 during preparation and pressing into discs prior to sintering, and then loading of sintered discs into the target holder 80 is preferably done within a glove box to confine the molybdenum powder from spreading out and about the work environment. After removal from the glove box, the loaded shield cask can be lifted by a crane hook engaging the handle 296 on the shield cask lid 295 (FIG. 22), and then moved by an overhead crane (not shown) to be placed on the shuttle tray 212 by lowering the shield cask base 292 onto pins 214 provided therefore on the shuttle tray 212 (FIGS. 19, 21). After the shield cask lid 295 is unsealed from the shield cask base 292 by unlocking the handles 294, the shield cask lid 295 is moved by the crane to the shuttle tray 212 and placed onto the receptacle 216 provided therefore in the shuttle tray 212. Then, the coolant cap lid 151 is removed from the coolant tube cap assembly 141 (FIGS. 18 (A), 18(B) that extends upward from the coolant tube housing 44 that communicates with the target irradiation chamber 42 (FIG. 9), by the grapple assembly 156 of the remote-controlled molybdenum handling apparatus 200 and placed onto a receptacle 218 provided therefore in the shuttle tray 212. The top of the cooling tube assembly 153 is engaged by the grapple assembly 156 and lifted out of the coolant tube housing 44 and placed into the tipping tower assembly 270 by positioning the coolant tube retaining ring 162 onto the upper support plate 272 of the tipping tower assembly 270. The tipping tower weldment is then moved from the vertical position into a horizontal position as previously described, by remote control of the grapple assembly 256. The grapple assembly 256 is then remotely manipulated to engage slots 82 in the end of the target holder 80 with the grapple pneumatic clamping tip 264, after which by remote control, the target holder is removed from the shield cask base 292 and inserted into and secured in the cooling tube body holder 105 at the bottom end of cooling supply tube 154. The tipping tower weldment is then moved from the horizontal position into the vertical position by remote control with the grapple assembly 256. The grapple assembly is 256 then used to remove the loaded cooling tube assembly 153 from the tipping tower assembly 270 and then lower the loaded cooling tube assembly 153 into the cooling tube housing 44 until the target holder 80 enters the target irradiation chamber 42. The target holder 80 is then precisely positioned and aligned by remote-controlled manipulation of the coolant supply tube 103 (or the coolant tube assembly 153) for maximum irradiation with a photon flux produced by the bremsstrahlung converter station 70. The upper hub assembly of the cooling water supply tube 141 is then sealed into the coolant tube housing 44 by mounting of the coolant tube cap 151. A first pressurized supply of coolant water is then sealingly attached to the coolant water supply pipe 50 for separately circulating coolant water through the bremsstrahlung converter station 70. A second pressurized supply of coolant water is then sealing attached to the water inlet pipe 46 for circulation through the target holder 80, the $^{100}$Mo target discs 85, and the radiation chamber 55 of the target radiation chamber 42. The linac 20 is then powered up to produce an electron beam for bombarding the tantalum plates 26 housed within the bremsstrahlung converter station 70 to produce a shower of bremsstrahlung photons for irradiating the target holder 80 loaded with the plurality of $^{100}$Mo target discs. It is suitable when using the high-power Jinn electron beam apparatus 10 disclosed herein comprising a 35 MeV, 40 kW electron linac 20 for irradiating a target holder housing a plurality of $^{100}$Mo target discs, to irradiate the target holder and discs for a period of time from a range of about 24 hrs to about 96 hrs, about 36 hrs to 72 hrs, about 24 hrs, about 36 hrs, about 48 hrs, about 60 hrs, about 72 hrs, about 80 hrs, about 96 hrs. After providing irradiation to the $^{100}$Mo target discs for a selected period of time, the linac 20 is powered down, the two supplies of coolant water are shut off, and the target irradiation chamber 42 is drained of coolant water. The cooling water supply is disconnected from the water inlet pipe 46 after which the coolant tube cap 151 is disengaged from the coolant tube cap assembly 141 by remote control of the grapple assembly 256 of the molybdenum handling apparatus 200 and placed onto receptacle 218 provided therefore on the shuttle tray 212. The cooling tube assembly 153 is then manipulated by remote control of the grapple assembly 256 to securely engage the irradiated target holder 80, after which, the cooling tube assembly 153 is removed from the coolant tube housing 44 and placed into the tipping tower assembly 270 by positioning the coolant tube retaining ring 162 onto the upper support plate 272 of the tipping tower assembly 270. The tipping tower weldment is then moved from the vertical position into a horizontal position as previously described, by remote control of the grapple assembly 256. The grapple assembly 256 is then remotely manipulated to engage slots 82 in the end of the irradiated target holder 80 with the grapple pneumatic clamping tip 264, after which the irradiated target holder 80 is removed from the shield cask base 292 and inserted into the shield cask base 292 by remote control of the grapple assembly 256. The shield cask lid 295 is then placed onto shield cask base 292 by the grapple assembly and locked in place by engaging the shield cask handles 294 with the shield cask lid. The shield cask 290 can then be moved with the overhead crane into a glove box for removal of the irradiated target holder 80.

At this point, it is optional to transfer the target holder 80 with the irradiated $^{100}$Mo target discs into a lead-lined container for shipping to a facility for recovery of $^{99m}$Tc therefrom. Alternatively, the target holder 80 with the irradiated $^{100}$Mo target discs can be transferred by remote control into a hot cell wherein $^{99m}$Tc may be separated and recovered from irradiated $^{100}$Mo target discs using equipment and methods known to those skilled in these arts. Suitable equipment for separating and recovering $^{99m}$Tc is exemplified by a TECHNEGEN® isotope separator (TECHNEGEN is a registered trademark of NorthStar Medical Radioisotopes LLC, Madison, Wis., USA). After recovery of the $^{99m}$Tc has been completed, the $^{100}$Mo is recovered, dried, and reformed into discs for sintering using methods known to those skilled in these arts.

The exemplary high-power linac electron beam apparatus disclosed herein for generating 40 kW, 35 MeV electron beam that is converted into a bremsstrahlung photon shower for irradiating a plurality of $^{100}$Mo targets to produce $^{99}$Mo through a photo-nuclear reaction on the $^{100}$Mo targets, has the capacity to produce on a 24-hr daily basis about 50 curies (Ci) to about 220 Ci, about 60 Ci to about 160 Ci, about 70 Ci to about 125 Ci, about 80 Ci to about 100 Ci of $^{99}$Mo from a plurality of irradiated $^{100}$Mo target discs weighing in aggregate about 12 g to about 20 g, about 14 g to about 18 g, about 15 g to about 17 g. Allowing 48 hrs for dissolution of $^{99}$Mo from the plurality of irradiated $^{100}$Mo target discs will result in a daily production of about 35 Ci to about 65 Ci, about 40 Ci to about 60 Ci, about 45 Ci to about 55 Ci of $^{99}$Mo for shipping to nuclear pharmacies.

It should be noted that while the exemplary high-power linac electron beam apparatus disclosed herein pertains to a 35 MeV, 40 kW electron linac for producing $^{99}$Mo from a plurality of $^{100}$Mo targets, the apparatus can be scaled-up to about 100 kW of electron-beam power, or alternatively, scaled-down to about 5 kW of electron-beam power.

The invention claimed is:

1. An apparatus for producing molybdenum-99 ($^{99}$Mo) from a plurality of molybdenum-100 ($^{100}$Mo) targets through a photo-nuclear reaction on the $^{100}$Mo targets, the apparatus comprising:

a linear accelerator component capable of producing an electron beam having at least 5 kW of power to about 100 kW of power;

a converter component capable of receiving the electron beam and producing therefrom a shower of bremsstrahlung photons having a flux of at least 20 MeV to about 45 MeV;

a target irradiation component for receiving the shower of bremsstrahlung photons, said target irradiation component having a chamber for receiving, demountingly engaging, and positioning therein a target holder housing a plurality of $^{100}$Mo target discs;

a cooling tube assembly for demountably engaging the target holder;

an elongate cooling tower for demountably receiving therein the cooling tube assembly, wherein a proximal end of the elongate coating tower is sealingly engaged with the target irradiation component and extending upward therefrom and a distal end of the elongate cooling tower has a demountable cap for sealingly engaging the distal end;

a demountable protective cladding encasing the linear accelerator component, the target irradiation component and the elongate cooling tower, said cladding having a port for receiving the distal end of the elongate cooling tower therethrough;

a framework mountable onto a top portion of the protective cladding, a remote controlled grapple assembly transportable along and within the framework, said grapple assembly demountably engageable with an end of the target holder, and the demountable cap of the cooling tube assembly;

a first cooling system sealingly engaged with the converter component for circulation of a coolant fluid therethrough; and a second cooling system sealingly engaged with the elongate cooling tower for circulation of a coolant fluid therethrough.

2. An apparatus according to claim 1, wherein the linear accelerator component is capable of producing an electron beam having at least 10 kW of power to about 100 kW of power.

3. An apparatus according to claim 1, wherein the linear accelerator component is capable of producing an electron beam having at least 20 kW of power to about 75 kW of power.

4. An apparatus according to claim 1, wherein the linear accelerator component is capable of producing an electron beam having at least 30 kW of power to about 50 kW of power.

5. An apparatus according to claim 1, wherein the converter component comprises a tantalum plate interposed the electron beam produced by the linear accelerator component.

6. An apparatus according to claim 1, wherein the converter component comprises at least one metal plate interposed the electron beam produced by the linear accelerator component.

7. An apparatus according to claim 6, wherein the metal plate is one of a copper plate, a cobalt plate, a iron plate, a nickel plate, a palladium plate, a rhodium plate, a silver plate, a tantalum plate, a tungsten plate, a zinc plate, and their alloys.

8. An apparatus according to claim 6, wherein the metal plate is a tantalum plate.

9. An apparatus according to claim 6, wherein the metal plate is a tungsten plate.

10. An apparatus according to claim 1, wherein the target holder houses about 4 to about 30 $^{100}$Mo target discs.

11. An apparatus according to claim 1, wherein the target holder houses about 8 to about 25 $^{100}$Mo target discs.

12. An apparatus according to claim 1, wherein the target holder houses about 12 to about 20 $^{100}$Mo target discs.

13. An apparatus according to claim 1, wherein the first cooling system comprises a sacrificial metal.

14. An apparatus according to claim 1, wherein the first cooling system is supplemented with a buffer.

15. An apparatus according to claim 14, wherein the buffer is one of by lithium hydroxide, ammonium hydroxide, and mixtures thereof.

16. An apparatus according to claim 1, wherein the second cooling system comprises a device for combining gaseous hydrogen generated within and recirculating in the second cooling system with oxygen to form water.

17. An apparatus according to claim 16, wherein the sacrificial metal is selected from a group consisting of copper, titanium, and stainless steel.

18. A system for producing molybdenum-99 ($^{99}$Mo) from a plurality of molybdenum-100 ($^{100}$Mo) targets through a photo-nuclear reaction on the $^{100}$Mo targets, the system comprising:

the apparatus of claim 1;

at least one target holder for receiving and housing therein a plurality of $^{100}$Mo target discs;

a supply of $^{100}$Mo target discs for installation into the target housing; and a remote-controlled equipment for remote-controlled installation of the target holder housing therein a plurality $^{100}$Mo target discs, into the apparatus for irradiation with a photon flux generated within the apparatus and for remote-controlled recovery of the target holder from the apparatus after a period of irradiation with the photon flux.

19. A system according to claim 18, additionally comprising an equipment for remote-controlled dispensing of the target holder housing the photon-irradiated $^{100}$Mo target discs into a lead-lined shipping container.

20. A system according to claim 18, additionally comprising a hot cell for receiving therein the target holder housing the photon-irradiated $^{100}$Mo target discs and for processing therein said photon-irradiated $^{100}$Mo target discs to separate and recover therefrom 99m-technetium ($^{99m}$Tc).

* * * * *